US010821586B2

(12) United States Patent
Wu et al.

(10) Patent No.: US 10,821,586 B2
(45) Date of Patent: Nov. 3, 2020

(54) ELECTRIC NAIL GUN USING AIR SPRING

(71) Applicant: HANGZHOU KELONG ELECTRICAL APPLIANCE TOOLS CO., LTD., Jiande County, Zhejiang Province (CN)

(72) Inventors: Qicheng Wu, Jiande County, Zhejiang Province (CN); Yurong Liu, Jiande County, Zhejiang Province (CN); Cai Ye, Jiande County, Zhejiang Province (CN); Lu Dai, Jiande County, Zhejiang Province (CN)

(73) Assignee: HANGZHOU KELONG ELECTRICAL APPLIANCE TOOLS CO., LTD., Jiande, Zhejiang (CN)

( * ) Notice: Subject to any disclaimer, the term of this patent is extended or adjusted under 35 U.S.C. 154(b) by 135 days.

(21) Appl. No.: 16/092,966

(22) PCT Filed: Jun. 23, 2016

(86) PCT No.: PCT/CN2016/086823
§ 371 (c)(1),
(2) Date: Oct. 11, 2018

(87) PCT Pub. No.: WO2017/201790
PCT Pub. Date: Nov. 30, 2017

(65) Prior Publication Data

US 2019/0202042 A1 Jul. 4, 2019

(30) Foreign Application Priority Data

May 26, 2016 (CN) ..... 2016 1 0363225

(51) Int. Cl.
*B25C 1/04* (2006.01)
*B25C 1/06* (2006.01)

(52) U.S. Cl.
CPC ..... *B25C 1/047* (2013.01); *B25C 1/04* (2013.01); *B25C 1/06* (2013.01)

(58) Field of Classification Search
CPC ..... B25C 1/04; B25C 1/047; B25C 1/06
(Continued)

(56) References Cited

U.S. PATENT DOCUMENTS 4,215,808 A 8/1980 Sollberger et al.
5,720,423 A 2/1998 Kondo et al.
(Continued)

FOREIGN PATENT DOCUMENTS

CN 101905455 A 12/2010
CN 101947765 A 1/2011
(Continued)

*Primary Examiner* — Stephen F. Gerrity
*Assistant Examiner* — Joshua G Kotis
(74) *Attorney, Agent, or Firm* — Muncy, Geissler, Olds & Lowe, P.C.

(57) ABSTRACT

An electric nail gun using an air spring, the driving mechanism thereof including a working cylinder, a pneumatic cylinder, an air storage chamber, a nailing component, a lifting device, a one-way component, a latching device, a separating device and a guiding component. The nailing component has a first longitudinal edge to cooperate with the lifting device and a second longitudinal edge to cooperate with the latching device and the separating device. The first longitudinal edge has several discontinuous and protruding faces separated apart from one another and cooperating with cylindrical and protruding pins of the lifting device. The second longitudinal edge has a latching groove to cooperate with the latching device, the latching groove corresponding to a detaching section for a cam of the lifting device.

14 Claims, 19 Drawing Sheets

(58) Field of Classification Search
USPC ..... 227/130
See application file for complete search history.

(56) References Cited

U.S. PATENT DOCUMENTS

| | | | | |
|---|---|---|---|---|
| 8,011,547 | B2 | 9/2011 | Leimbach et al. | |
| 8,079,504 | B1 * | 12/2011 | Pedicini | B25C 1/06 227/130 |
| 2006/0180631 | A1 | 8/2006 | Pedicini et al. | |
| 2009/0090759 | A1 | 4/2009 | Leimbach et al. | |
| 2011/0198381 | A1 * | 8/2011 | McCardle | B25C 1/06 227/8 |
| 2014/0202724 | A1 * | 7/2014 | Moore | B25C 1/042 173/46 |
| 2016/0229043 | A1 * | 8/2016 | Wyler | B25C 1/047 |
| 2016/0288305 | A1 * | 10/2016 | McCardle | B25C 1/06 |
| 2018/0036870 | A1 * | 2/2018 | Komazaki | B25C 1/047 |
| 2018/0126527 | A1 * | 5/2018 | Pomeroy | B25C 1/047 |

FOREIGN PATENT DOCUMENTS

| | | | |
|---|---|---|---|
| CN | 102059680 | A | 5/2011 |
| CN | 202106356 | U | 1/2012 |
| CN | 204382218 | U | 6/2015 |
| CN | 205835215 | U | 12/2016 |
| JP | 2007044799 | A | 2/2007 |

* cited by examiner

ELECTRIC NAIL GUN USING AIR SPRING

BACKGROUND OF THE INVENTION

1. Field of the invention

The invention relates to an electric nail gun, in particular to an electric nail gun using a gas spring.

2. Description of the Related Art

An early air spring nail gun is disclosed in U.S. Pat. No. 4,215,808, to Sollberger. Sollberger's patent is to use a rack and a pinion to lift the piston to the preparatory position. A separate flexible mechanical cable is used to drive the mechanical output of the motor through the drive train to the pinion gear of the nail gun.

Another type of air spring nail gun is disclosed in U.S. Pat. No. 5,720,423, to Kondo. This Kondo patent uses a separate air replenishing supply tank with an air replenishing piston to supplement the pressurized air required to drive a piston, which in turn drives a nail into the object.

Another type of gas spring nail gun is disclosed in the published U.S. Patent Application No. US20060180631 to Pedicini, which uses a rack and pinion to move the piston back to the preparatory position. The rack and pinion are decoupled during the power stroke. Pedicini's tools use a pressure relief valve to supplement the air lost during nail drive.

Another type of gas spring nail gun is disclosed in U.S. Pat. No. 8,011,547, to Senco, which uses a gas spring principle to provide a fast downward power stroke and uses a cam-shaped rotary linear lifter which has a plurality of cylindrical projecting pins on the circumferential surface. It needs a plurality of rotations of the lifter to lift the nailing member back to the preparatory position, and holding the lifter in a predetermined position by a one-way member. It also includes a cylinder and a gas storage chamber, and the ratio of the displacement volume of the gas storage chamber to that of the cylinder is at least 2:1, and the pressurized air is filled in the gas storage chamber at the beginning with a dedicated inflation device, and the tool does not have air supply system. The disadvantage is that there is always a compressed gas stored in the gas storage chamber. In the event of a collision, there is a safety hazard of the explosion; even in the non-working state, the one-way member is always under the high pressure load of the gas spring, and is easy to wear failure, once it fails it will lead to misstriking. The structure of the tool seems simple, but the sealing requirements of the tool are very high, and the manufacturing process is difficult. The piston seal as a long-stroke dynamic seal will wear after repeated reciprocating work, cause pressurized air quickly releases or even completely leaks, and the tool will fail. After the failure, the operator cannot repair the tool due to the lack of inflatable equipment.

The Senco patent has a nailing component with at least a first longitudinal edge that is substantially parallel to the direction of movement of the nailing component between the nailing position and the preparatory position, having a plurality of spaced-apart protrusions. The cylindrical pins contacting the discontinuous working surface with at least one plurality of spaced-apart protrusions along said first longitudinal edge of the nailing component, the lifter driving the nailing component from its nailing position to the preparatory position while the latching device interfering with the latching groove of the nailing component to prevent the nailing component from falling back. The first longitudinal edge includes the left and right longitudinal edges that are parallel and identical to each other, wherein the protrusions of the left edge interacts with the cylindrical projecting pin on the lifter, while the protrusions on the right edge interact with the latching device.

The cam edge of the lifter is divided into a lifting section and a detaching section, and the lifting section is provided with a plurality of cylindrical protruding pins, and the cylindrical protruding pins are sequentially inserted into the protrusions of the left edge to lift the nailing component. The cylindrical protruding pin is not provided on the detaching section, leaving a space for the nailing component to move. Between the adjacent cylindrical projecting pins of the lifter, there is a gap to lift the nailing component, when a cylindrical projecting pin has just left the spaced-apart protrusions along said first longitudinal edge, the next cylindrical projecting pin has not been inserted yet. During the gap period the nailing component is supported by the latching device to prevent the nailing component from falling back under air pressure. The detaching section is formed between the end cylindrical projecting pin and the first one.

The disadvantage of Senco patent is that the spacing protrusion of the left longitudinal edge of the nailing component is subjected to the continuous impact of the lifter during the lifting process; during the gap period, the spaced apart protrusion of the right longitudinal edge impacts the latching device, and the right longitudinal edge receives so many impacts that it is easily bent and deformed, that causes the tool to fail.

The Senco patent also has a latching device controlled by the separating means of the electromagnetic coil. when the nailing component is on driving stroke (the direction of movement of the nailing component this moment is the first direction), the latching device is forced into a non-contact position so that its latching surface does not interfere with the plurality of spaced apart protrusions of the nailing component; when the nailing component returns to the preparatory position (the direction of movement this moment of the component is the second direction), the separating device releases its latching device. The latching device is directed to the latching groove of the nailing component, and the sliding surface of the latching device allows the second longitudinal edge with a plurality of spaced-apart protrusions of the nailing component slides to move against the latching device, and the latching surface of the latching device is engaged under the spaced apart protrusions of the nailing component to prevent the nailing component from falling. The disadvantage is that the separating device is controlled by the electromagnetic coil. Since the tool vibrates greatly during operation, and the electromagnetic coil is installed close to the striking end of the nailing member, the connection of the electromagnetic coil is easily desoldered under great vibration or the wire breaks, and the tool fails. Moreover, the manufacturing cost of the electromagnetic coil is much higher than that of the mechanical component, which in turn increases the cost of the tool, and also accelerates the loss of the tool battery power, reducing the number of nailing times in one charging cycle, and reducing battery life.

Another disadvantage of the Senco patent is that the requirement of accuracy of the components is very high, it is not suitable for poor environments, and the operational reliability is poor. The cylindrical protruding pin of the lifter and the spaced-apart protrusion of the nailing member are rubbed and impacted many times, and are easily worn, so that the nailing member cannot be lifted in right position, and the latching device cannot enter the position of the spaced-apart latching groove, thereby causing the tool to fail.

The wear of the cylindrical protrusion pin of the lifter also causes the failure of the lifter to lift slightly the nailing component to the right place when the nail needs to be shot, and the latching surface of the latching component cannot be disengaged from and the lowest protrusion of the nailing component, and the nailing component still presses the latching component under the action of the high-pressure air, so that the separation device of the electromagnetic coil cannot pull the latching component, and the electromagnetic coil will be burnt due to the excessive load, and the tool is immediately invalid.

SUMMARY OF THE INVENTION

The invention aims to overcomes the above disadvantages of the prior art, and provides an electric nail gun using a gas spring with good safety, durability and power saving.

An electric nail gun using an air spring, the driving mechanism thereof comprising: a working cylinder, an pneumatic cylinder, an air storage chamber, a nailing component, a lifting device, a one-way component, a latching device, a separating device and a guiding component, wherein:

(1) the working cylinder comprises a cylindrical wall and has a nailing piston which is movable therewithin, said working cylinder has a first end and a second end, opposite to the first end between which there is a working plenum, said working plenum containing a displacement volume created by a stroke of the nailing piston;

(2) the pneumatic cylinder has a fifth end and sixth end, opposite to the fifth end and a pneumatic room between the two ends, wherein an air filling piston moves; said fifth end being in one-way fluidic communication with said air storage chamber, said sixth end having an air intake hole;

(3) the air storage chamber being in fluidic communication with said working plenum of the working cylinder, unidirectionally receiving air from the pneumatic room;

(4) the nailing piston is coupled to the, third end of the nailing component, including:

(i) the nailing component having a fourth end, opposite to the third end that is sized and shaped to push a nail from a exit end of a guiding component, wherein a passageway of the guiding component allows said nailing component to pass therethrough toward said exit end during a driving stroke and toward a receiving end during a return stroke, said nailing component, when at a nailing position, protrudes toward said exit end of the guiding component after said nailing piston moves toward the second end of said working cylinder, and said nailing component, when at a preparatory position, is withdrawn into said guiding component after the nailing piston moves toward the first end of the working cylinder, (ii) the nailing component having a first longitudinal edge that is substantially parallel to the direction of movement of said nailing component between its nailing position and preparatory position, said nailing component having a discontinuous working surface with at least one plurality of spaced-apart protrusions along said first longitudinal edge cooperating with the cylindrical projecting pins of the lifting device;

(iii) the nailing component having a second longitudinal edge that is substantially parallel to the direction of movement of said nailing component between its nailing position and preparatory positions, said second longitudinal edge having a latching groove cooperating with the latching device, said latching groove corresponding to a detaching section of the cam of the lifting device;

(iiii) the nailing component having a toggling slot adjacent the fourth end that cooperates with the separating device, the toggling slot being interlocked with the separating device;

(5) a lifting device includes a cam having a discontinuous contact surface, the cam edge is divided into a lifting section and a detaching section, and the lifting section being provided with the plurality of cylindrical projecting pins, the cylindrical projecting pins are inserted sequentially into spaced-apart protrusions of the first longitudinal edge of the nailing component in turn to lift the nailing component, wherein no cylindrical projecting pins are disposed on the detaching section, leaving a space for the nailing component to move in the first direction; under second predetermined conditions, the lifting section of the cam faces the first longitudinal edge, the cylindrical projecting pins contacting the discontinuous working surface with at least one plurality of spaced-apart protrusions along said first longitudinal edge of the nailing component, the lifting device drives the nailing component from its nailing position to the preparatory position; under the first predetermined condition, the detaching section of the cam faces the first longitudinal edge of the nailing component;

(6) the one-way component drives the lifting device to rotate, the lifting device drives the nailing component to move to the preparatory position, under the second predetermined conditions, the one-way component keeps the nailing component in the preparatory position; under the third predetermined condition, the pneumatic piston reciprocates in the pneumatic cylinder to compress air into the gas storage chamber while the rotation of the one-way member does not drive the lifting device to move;

(7) the latching device having a latching surface, a sliding surface and a pawl, wherein:

(i) under the first predetermined condition, the driving end of the separating device drives the pawl of the latching device to cause said sliding surface of the latching device to enter the non-catching position such that its latching surface does not interfere with the latching groove of the second longitudinal edge of the nailing component, thereby allowing the nailing component to move from its preparatory position in the first direction to the exit end of the guiding component;

(ii) under the second predetermined condition, when the nailing component returns to the preparatory position, the separating device releases the latching device thereof, so that the latching device is pressed to a second longitudinal edge of the nailing component allowing the second longitudinal edge of the nailing component to slide along a sliding surface of the latch device, and the nailing component directs the latching surface of the latching device toward the latching groove of the nailing component until the latching surface of the latching device interferes with the latching groove of the nailing component, so that the nailing component keeps on moving in the second direction without any reverse;

(8) a separating device having a driving end and a toggling end;

(i) under the first predetermined condition, while the nailing piston pushes the nailing component from its preparatory position to the exit end of the guiding component in the first direction under the action of compressed air in the working cylinder and the air storage chamber; the toggling slot of the nailing component directs the driving end of the separating device, and the toggling end of the separating device makes the latching device to separate from the nailing component so that the latching surface of the latching device does not interfere with the latching groove of the second longitudinal edge of the nailing component, thereby allowing the nailing component to move from its preparatory position to the exit end of the guiding component in the first direction;

(ii) under the second predetermined condition, when the nailing component returns to the preparatory position, the separating device releases the latching device so that the latching device is pressed to the second longitudinal edge of the nailing component;

(9) a guiding component is disposed adjacent to the second end of the working cylinder, the guiding component has the receiving end, the exit end, and a passageway between the receiving end and the exit end, the receiving end being adjacent to the second end of the working cylinder, the guiding component being configured to receive a nail from the exit end.

Further, the gas storage chamber is configured as one of the following:

(a) substantially surrounding at least a portion of the working cylinder, or (b) substantially standing by one side of the working cylinder.

Further, while the nailing component is moving in the first direction, the lifting device is rotated by a driving shaft.

Further, the latching device is pivotable and loaded by a spring; the pawl of the latching device is pivotable and loaded by a spring; the pawl has a pushed face and a dialed face;

(4a) under the first predetermined condition, when the nail component moves from its preparatory position to the exit end of the guiding component, the toggling slot of the nailing component directs the driving end of the separating device to attach to the second longitudinal edge of the nailing component, and the toggling end of the separating device is rotated to drive the dialed surface of the pawl of the latching device, so that the latching device is quickly separated from the second longitudinal edge of the nailing component, wherein when the toggling end of the separating device is rotated to a certain angle, the pawl of the latching device is released, and the latching device is attached to the second longitudinal edge of the nailing component again under the action of a spring force;

(4b) under the second predetermined condition, when the nailing component returns to the preparatory position, the latching device is pressed to the second longitudinal edge of the nailing component, the latching device is directed toward the latching groove of the nailing component until the latching surface of the latching device interferes with the latching groove of the nailing component, so that the nailing component remains moving in the second direction without any reverse, wherein when the toggling slot of the nailing component moves to align with the driving end of the separating device, the driving end of the separating device enters the toggling slot of the nailing component under the action of a spring force, then the nailing component drives the separating device to rotate, then the toggling end of the separating device pushes the pushed surface of the pawl of the latching device, and the pawl of the latching device dodges the toggling end of the separating device to bring the toggling end of the separating device to the dialed surface of the pawl of the latching device.

Further, the separating device is pivotable and loaded by a spring, the driving end of the separating device being interlocked with the nailing component, and the toggling end of the separating device toggles the pawl of the latching device.

Further, wherein: the compressed air is stored in the air storage chamber and the working plenum, and the compressed air pushes the nailing piston and is always pressurized above atmospheric pressure.

Further, at least one seal of the nailing piston is included that functions to retain a majority of the pressurized gas in the air storage chamber and working plenum.

Further, at least one seal of the pneumatic piston is included that functions to increase the pressure of the gas in the pneumatic room.

Further, at least one one-way valve is disposed between the gas storage chamber and the pneumatic room that functions to one-way pressurize compressed gas from the pneumatic room into the gas storage chamber.

Further, a pressure sensor is disposed on the gas storage chamber to detect the pressure of the compressed air in the gas storage chamber, and to stop the inflation in time to ensure the safety of the tool.

Further, a pressure relief valve is disposed on the gas storage chamber to discharge compressed air of the gas storage chamber to ensure the safety of the tool during the storage and transportation, and to eliminate the load on the one-way component in a non-working state of the one-way component.

Further, a magazine is disposed for supporting a series of nails, and for continuously providing the nails through the opening of the guiding component to a corresponding position where the nailing component operates in the driving stroke.

Further, (a) the first predetermined condition occurs during the driving stroke phase; (b) the second predetermined condition occurs in the lift interval phase; (c) The third predetermined condition occurs during the inflation phase.

The invention has the advantages that: firstly, the self-contained inflation system has no compressed air in the air storage chamber of the nail gun when the vehicle is shipped, and there is no safety hazard of the explosion, and the air is first inflated into the gas storage cylinder during use, and then the compressed air in the gas storage chamber is released after the completion of the operation, and the one-way member is not subjected to any load in the non-working state, thereby ensuring the safety of the tool during storage and transportation, and also improving the flexibility and service life of the tool;

secondly, the nail member has two asymmetric longitudinal edges, the first longitudinal edge having a plurality of spaced-apart protrusions that cooperate with the cylindrical projection pins of the lifting device, and only the latching groove which corresponding to the detaching section of the cam of the lifting device is opened on the second longitudinal edge, the number of slots is greatly reduced, the overall strength is increased, and the number of impacts between the nailing member and the bolt is greatly reduced during the lifting process. It is beneficial to reduce the wear of parts of the tool;

thirdly, the separation device adopts a controlling system of pure mechanical structure which not only increases the robustness and reliability of the tool, but also greatly reduces the failure rate of the tool and also significantly reduces the manufacturing cost and the maintenance cost of the tool, and increase the number of nailing times of one charging cycle of the battery, and also save the power of the battery;

Fourth, since only a latching groove corresponding to the detaching section of the cam is opened in the second longitudinal edge, when the nailing component returns to the preparatory position at the end of the second predetermined condition, the latch rests on the second longitudinal edge of the nailing component, instead of being inserted into the latching groove of the nailing component, so that when the nailing component is in the preparatory position, the latching device is not pressed by the second longitudinal edge, thence the slight height that the lifting device lifts the nailing component does not affect the withdrawal of the latching device, thereby eliminating the influence of the wear of the cylindrical protruding pin of the lifting device on the withdrawal of the latching device, thus reducing the requirement of the accuracy of the parts and extending the life of the equipment that is very important for a nail gun with a harsh working environment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Reference will now be made in detail to the present preferred embodiment of the invention, an example of which is illustrated in the accompanying drawings, wherein like numerals indicate the same elements throughout the views.

In the figures: 1, working cylinder; la, separated working cylinder; 2, pneumatic cylinder; 3, gas storage chamber; 3*a*, gas storage chamber positioned outside; 4, nailing component; 5, lifting device; 6, one-way component; 7, latching device; 8, separating device; 9, guiding component; 10, magazine; 11, the first end of the working cylinder; 12, the second end of the working cylinder; 13, the working plenum; 20, the gearbox; 21, the fifth end of the pneumatic cylinder; 22, the sixth end of the pneumatic cylinder; 23, pneumatic room; 24, pneumatic piston; 25, air intake hole; 26, check valve; 27, sealing port, 30, motor; 31, pressure sensor; 32, pressure relief valve; 40, trigger, 41, nailing piston; 42, the third end of the nailing component; 43, the fourth end of the nailing component; 44*a*, the first longitudinal edge of the nailing component (the surface has several spaced-apart protrusion); 44*b*, a first longitudinal edge of the nail component (the surface has a plurality of discontinuous slots); 44*c*, a first longitudinal edge of the nail component (the side has a plurality of discontinuous protrusions); 45*a*, spaced-apart protrusions on the 1$^{st}$ longitudinal edge; 45*b*, discontinuous slots on the first longitudinal edge; 45*c*, discontinuous protrusions on the first longitudinal edge side;

46, the second longitudinal edge of the nailing component; 47, latching grooves on the second longitudinal edge; 48, toggling slot on the nail component; 50, battery; 51*a*, cylindrical projecting pin of the lifting device; 51*b*, discontinuous projecting teeth of the lifting device; 52, cam; 52*a*, lifting section; 52*b*, detaching section; 53, driving shaft; 60, bumper; 70, shift lever, 71, latching surface of the latching device; 72 sliding surface of the latching device 73, pawl of the latching device; 74, first spring; 75, second spring; 80, air sealing plug, 81, driving end of the separating device; 82, toggling end of the separating device; 83, third spring; 91, receiving end of the guiding component; 92, exit end of the guiding component; 93, passageway of the guiding component; 101, nail; 241, pneumatic piston seal; 731, pushed surface of the pawl; 732, dialed surface of the pawl.

Embodiment 1

Figure 2:
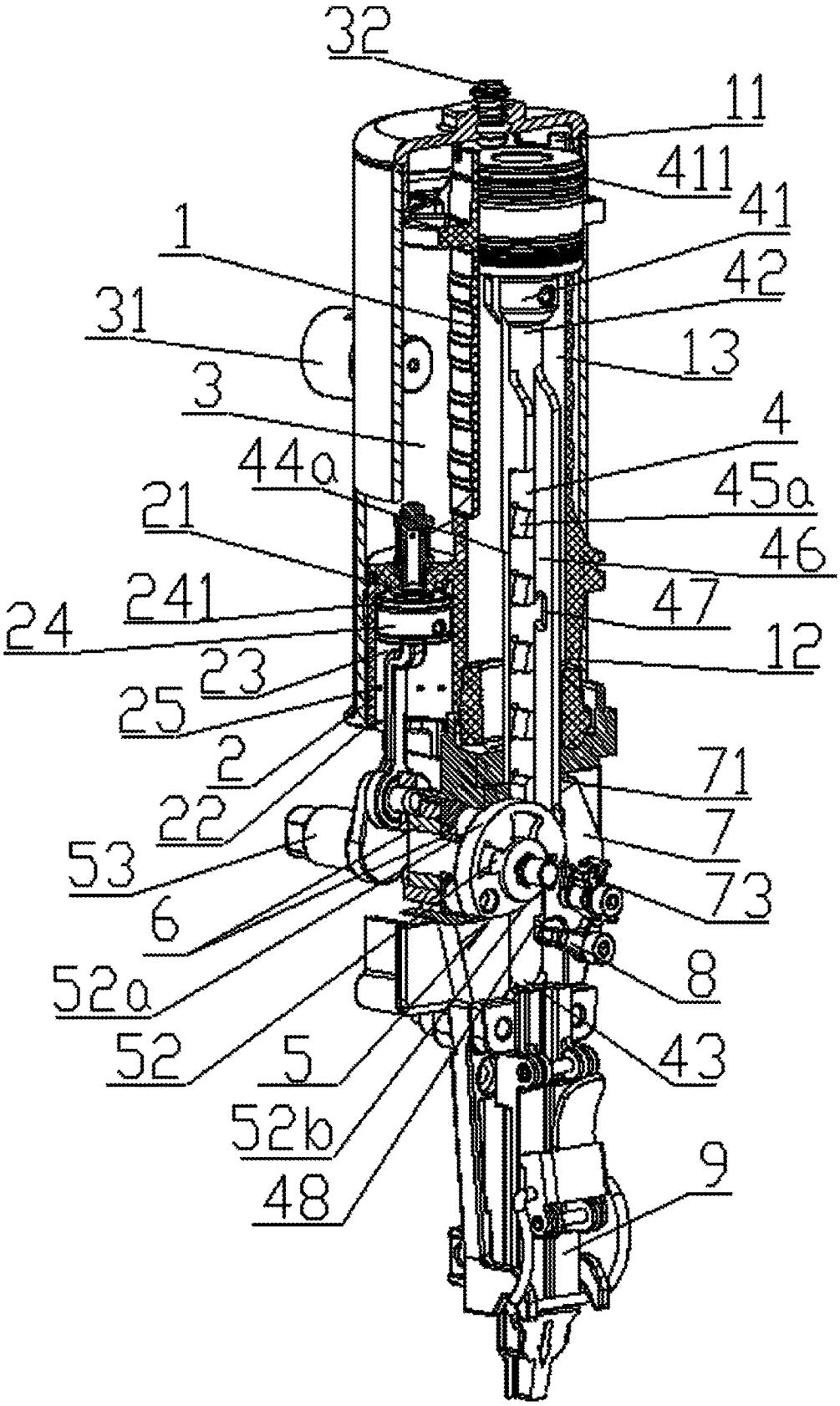
FIG. 2 is a partial cross-sectional view showing the upper side of a driving mechanism according to an embodiment of the present invention.

As shown in FIG. 2, an electric nail gun using a gas spring, the driving mechanism thereof comprises a working cylinder 1, a pneumatic cylinder 2, an air storage chamber 3, a nailing component 4, a lifting device 5, a one-way member 6, a latching device 7, a separation device 8, a guiding member 9.

As shown in FIG. 2, the working cylinder 1 has a first end 11 and an second, opposite end 12, and a working plenum 13 is formed between the two ends for the nailing piston 41 to move within the working plenum 13.

As shown in FIG. 2, the pneumatic cylinder 2 has a fifth end 21 and a sixth, opposite end 22, between which an plenum 23 is formed for the pneumatic piston 24 to move within the plenum 23, the fifth end 21 is unidirectionally connected to the gas storage chamber 3, and has an air intake hole 25 near the sixth end 22.

As shown in FIG. 2, the air storage chamber 3 surrounds at least a portion of the working cylinder 1, and the air storage chamber 3 is in gas communication with the working plenum 13 of the working cylinder 1 receiving the gas of the plenum 23 one-way.

Figure 5:
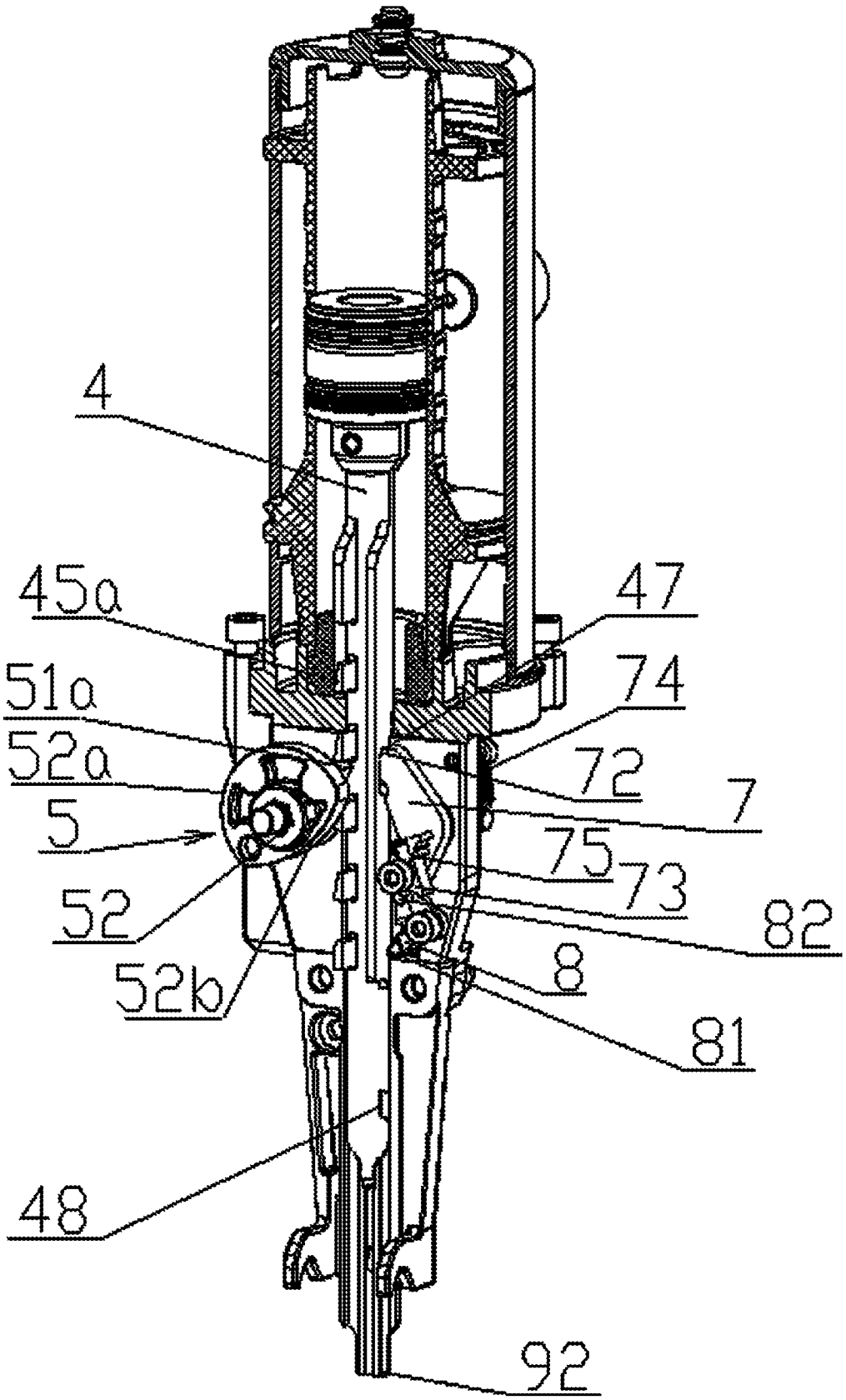
FIG. 5 is a partial schematic view showing the driving mechanism under the second predetermined condition when the latching device contact the latching groove of the second longitudinal edge of the nailing component.

As shown in FIG. 2 and FIG. 5, the nailing component 4 having the nailing piston 41 mechanically couples the third end 42 of the nailing component 4.

The nailing component 4 includes a fourth end 43, opposite to the third end 42 that is sized and shaped to push the nail 101 from the exit end 92 of the guiding component 9, wherein the passageway 93 of the guiding component 9 allows the nailing component 4 to pass through during driving stroke and return stroke. When in the nailing position, the nailing component 4 protrudes toward the exit end 92 of the guiding component 9 after the nailing piston 41 moves toward the second end 12 of the working cylinder 1; and said nailing component 4, when at the preparatory position, is withdrawn into said guiding component 9 after the nailing piston 41 moves toward the first end 11 of the working cylinder 1.

The nailing component 4 has the first longitudinal edge 44*a* with a plurality of spaced-apart protrusions 45*a* that cooperate with the cylindrical projecting pin 51*a* of the lifting device 5, and the first longitudinal edge 44 is substantially parallel to the direction of movement of the nailing component 4.

The nailing component 4 has a second longitudinal edge 46, the second longitudinal edge 46 having a latching groove 47 that cooperates with the latching device 7, the latching groove 47 corresponding to the detaching section 52*b* of the cam of the lifting device 5, the second longitudinal direction edge 46 is substantially parallel to the direction of movement of the nailing component 4.

The nailing member 4 has a toggling slot 48 engaged with the separating device 8 near the fourth end 43, and the toggling slot 48 is interlocked with the separating device 8.

As shown in FIG. 5, the lifting device 5 includes a cam 52. The edge of the cam 52 is divided into a lifting section 52*a* and a detaching section 52*b*. The lifting section 52*a* is provided with a plurality of cylindrical projecting pins 51*a*. The projecting pin 51*a* is sequentially inserted under the spaced-apart protrusion 45*a* on the first longitudinal edge of the nailing component 4 to lift the nailing component 4; and no cylindrical protruding pin is provided on the detaching section 52*b*, leaving a space for the nailing component 4 to move in the first direction; under the second predetermined condition, the lifting section 52*a* of the cam faces the first longitudinal edge 44*a* of the nailing component 4, and the cylindrical projecting pin 51*a* contacts at least one of the spaced-apart protrusions 45*a* on the first longitudinal edge 44*a* of the nailing component 4, driving the nailing component 4 to move from its nailing position to the preparatory position; under the first predetermined condition, the detaching section 52*b* of the cam faces the first longitudinal edge 44*a* of the nailing member.

Figure 8:
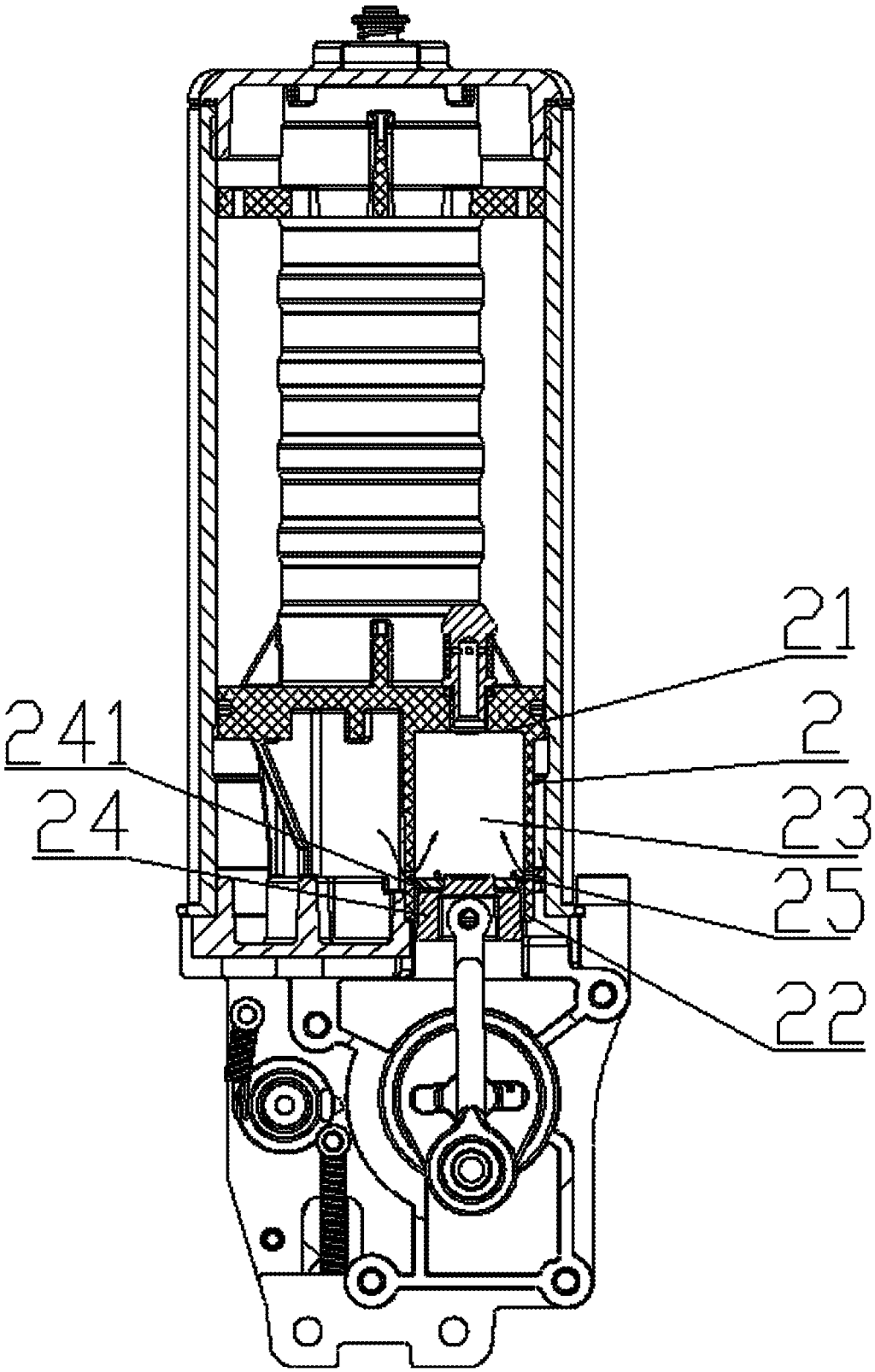
FIG. 8 is a schematic view showing a partial section of the suction of the driving mechanism under the third predetermined condition in the first embodiment of the present invention.
Figure 9:
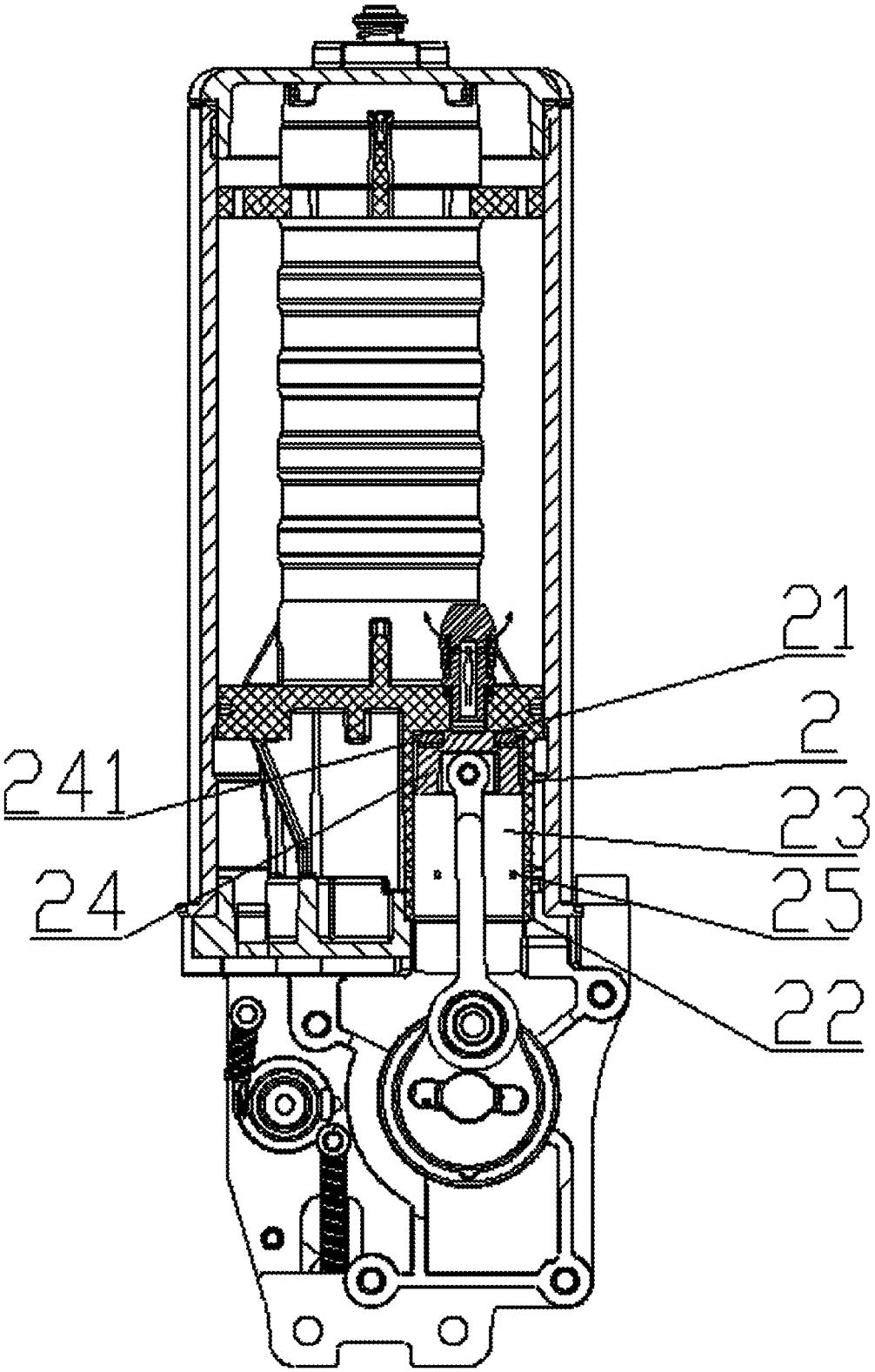
FIG. 9 is a schematic view showing a partial section of the inflate of the driving mechanism under the third predetermined condition in the first embodiment of the present invention.
Figure 10:
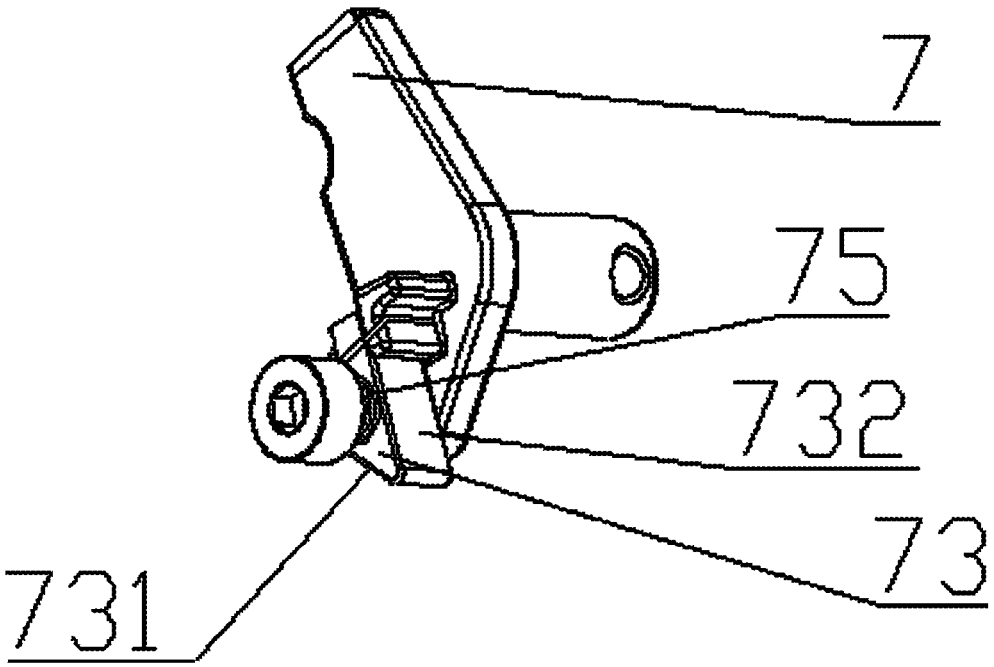
FIG. 10 is a perspective view of the latching device of the driving mechanism in the first embodiment of the present invention.

As shown in FIG. 2, under the second predetermined condition, the one-way component 6 drives the lifting device 5 to rotate, and the lifting device 5 drives the nailing component 4 to move to the preparatory position, and the one-way component 6 keeps the lifting device 5 in the preparatory position. As shown in FIGS. 8 and 9, under the third predetermined condition, the pneumatic piston 24 reciprocates in the pneumatic cylinder 2 to compress the air into the gas storage chamber 3 while the rotation of the one-way component 6 does not drive the lifting device 5 to move.

Figure 3:
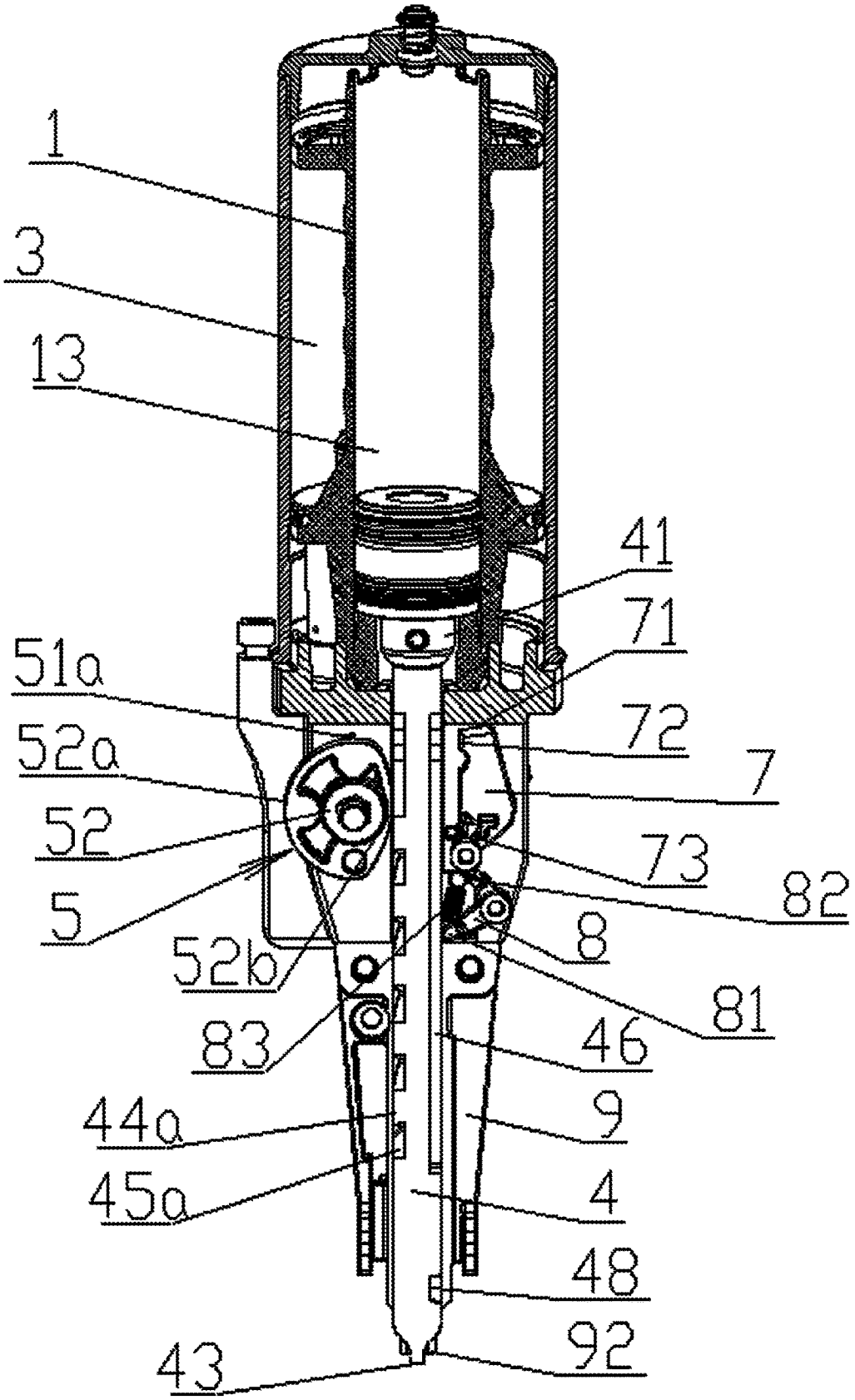
FIG. 3 is a partial cross-sectional view showing a driving mechanism at a driving stroke phase under the first predetermined condition according to an embodiment of the present invention.
Figure 4:
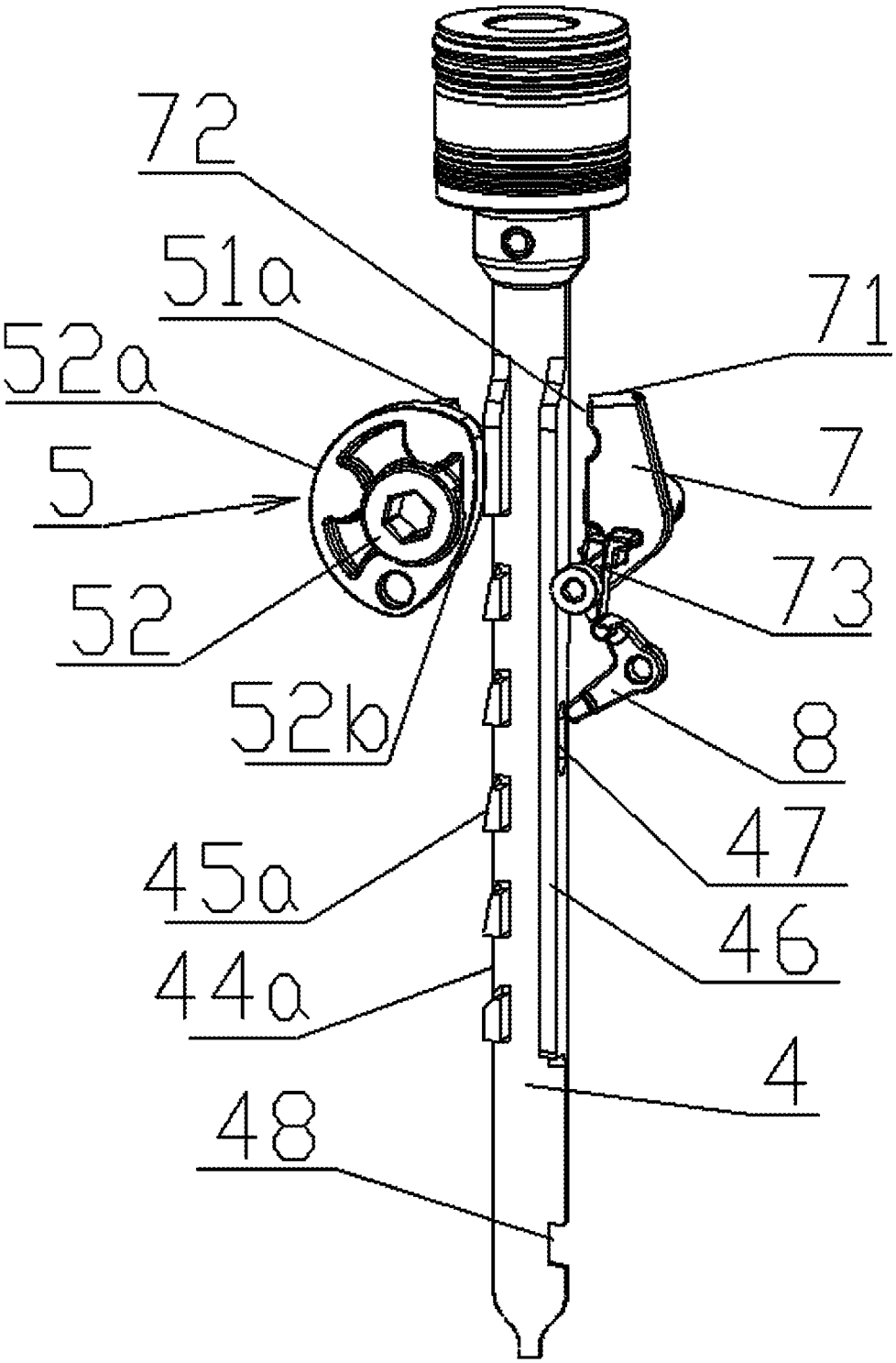
FIG. 4 is a schematic diagram showing the relationship between the lifting device, the separating device and the latching device of the driving mechanism under the first preset condition in the first embodiment of the present invention.

As shown in FIGS. 3 and 4, the latching device 7 has a latching surface 71, a sliding surface 72 and a pawl 73, wherein:

Under the first predetermined condition, the toggling end 82 of the separating device 8 toggles the pawl 73 of the latching device 7 to bring the sliding surface 72 of the latching device 7 into a non-contact position, so that its latching surface 71 does not interfere with the latching grooves 47 of the second longitudinal edge 46 of the nailing component 4, thereby allowing the nailing component 4 to move from the preparatory position toward the exit end 92 of the guiding component 9 in a first direction.

Figure 6:
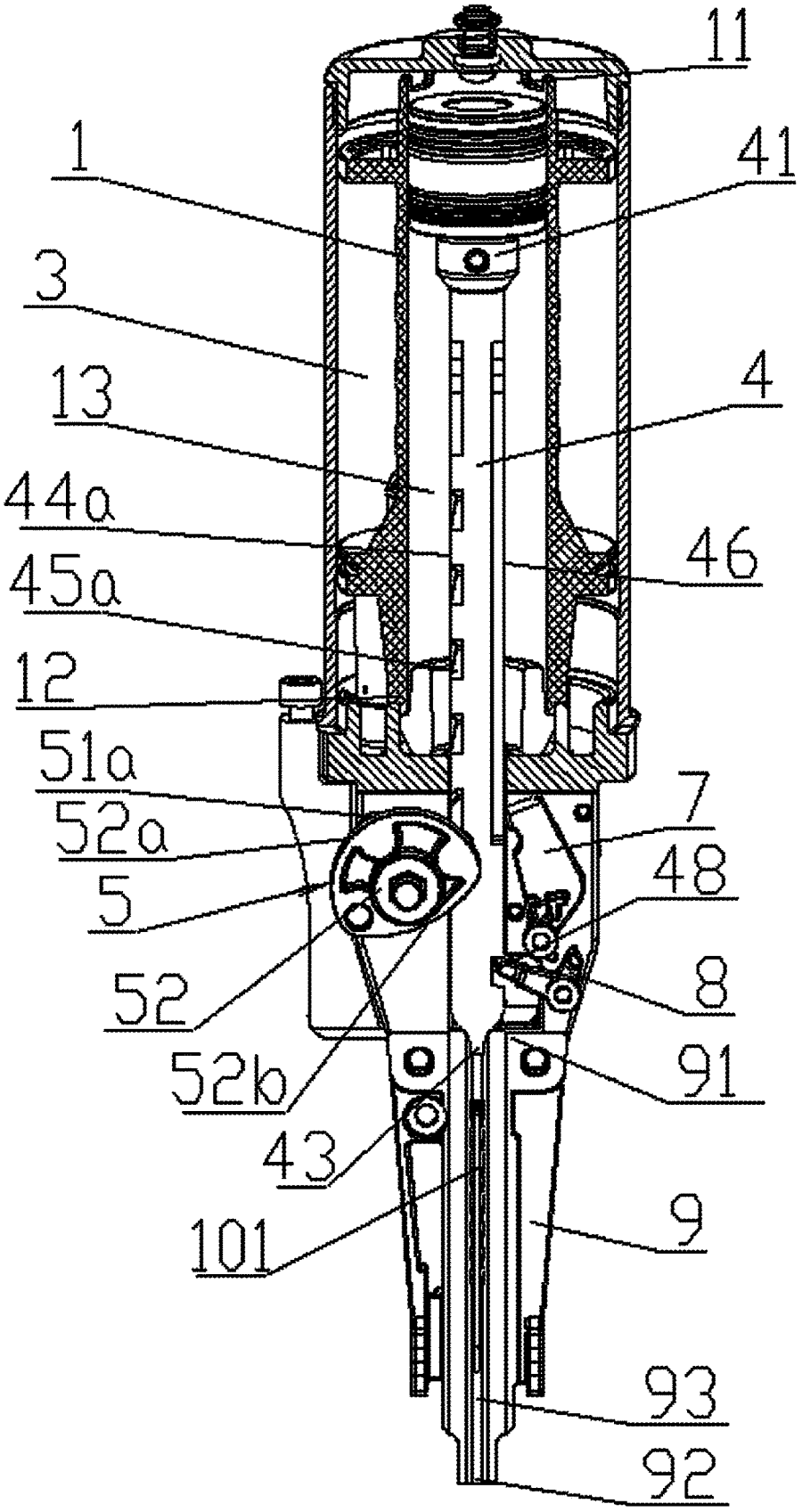
FIG. 6 is a partial schematic view showing the driving mechanism in the preparatory position in the first embodiment of the present invention.
Figure 7:
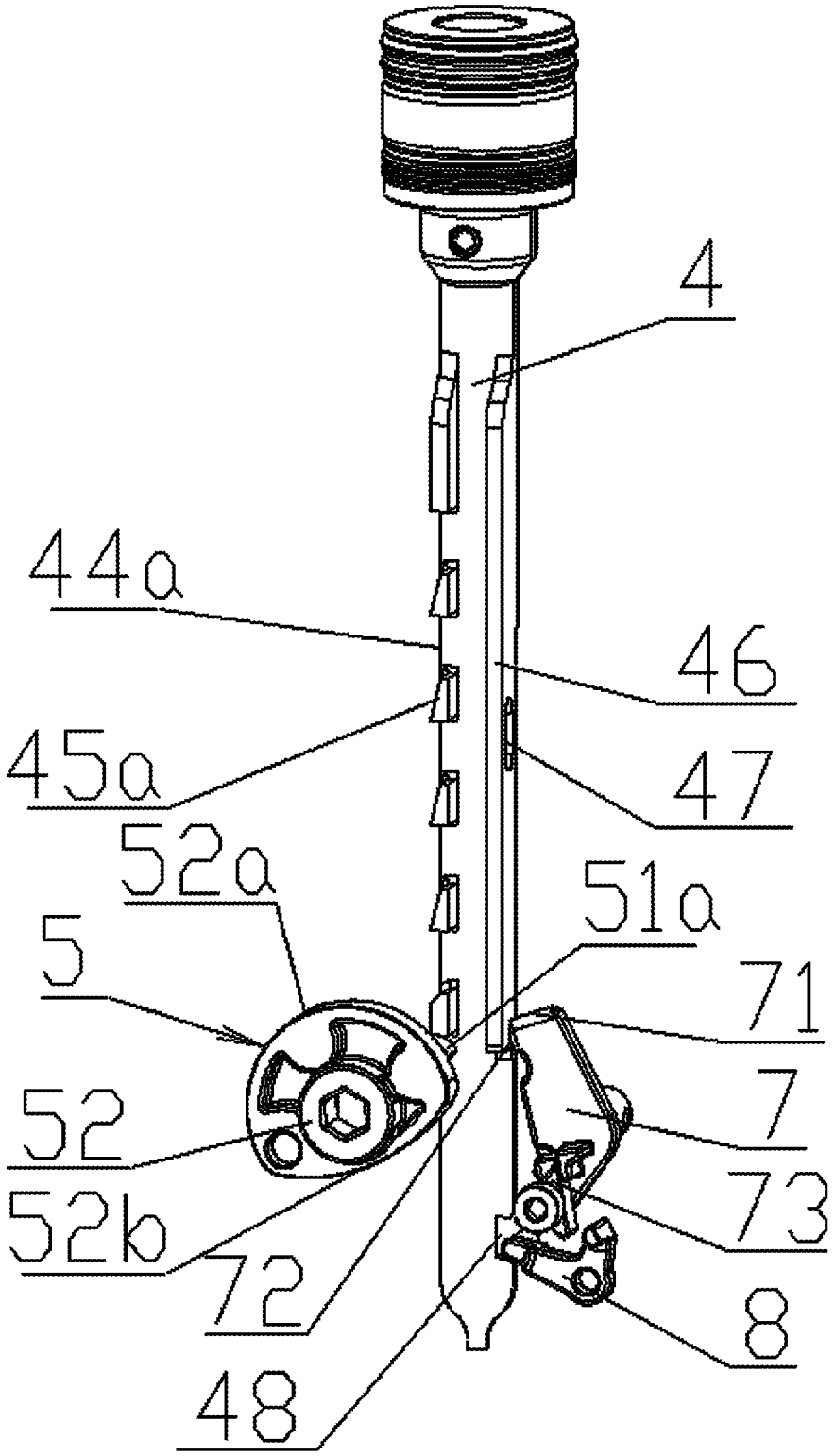
FIG. 7 is a partial enlarged view of FIG. 6.

As shown in FIG. 5, FIG. 6, and FIG. 7, under the second predetermined condition, when the nailing component 4 returns to the preparatory position, the separating device 8 releases its latching device 7, so that the latching device 7 is pressed to the second longitudinal edge 46 of the nailing component 4, allowing the second longitudinal edge 46 of the nailing component 4 to slide along the sliding surface 72 of the latching device 7, and the nailing component 4 directs the latching surface of the latching device 7 to the latching groove 47 of the nailing component 4 until the latching surface 73 of the latching device 7 interferes with the latching groove 47 of the nailing component 4, so that the nailing component 4 keeps on moving in the second direction without any reverse.

As shown in FIG. 3, FIG. 4, FIG. 5, FIG. 6, FIG. 7, the separating device 8 has a driving end 81 and a toggling end 82;

Under the first predetermined condition, when the nailing piston 41 is pushed by the compressed air in the gas storage chamber 3 and the working plenum 13, the nailing component 4 moves from the preparatory position to the exit end 92 of the guiding component 9 in the first direction, and the toggling slot 48 of the nailing component 4 directs the driving end 81 of the separating device 8, and the toggling end 82 of the separating device 8 quickly separates the latching device 7 from the nailing component 4, so that the latching surface 71 of the latching device 7 does not interfere with the latching groove 47 of the second longitudinal edge 46 of the nailing component 4, thereby allowing the nailing component 4 to move from its preparatory position toward the exit end 92 of the guiding component 9 in the first direction;

Under the second predetermined condition, when the nailing component 4 returns to the preparatory position, the separating device 8 releases the latching device 7, so that the latching device 7 is forced to attach to the second longitudinal edge 46 of the nailing component 4.

As shown in FIG. 6 and FIG. 7, the guiding component 9 is disposed adjacent to the second end 12 of the working cylinder 1, and has a receiving end 91, an exit end 92, and a passageway 93 between the receiving end 91 and the exit end 92. The receiving end 91 is close to the second end 12 of the working cylinder 1, and the guiding component 9 is arranged to receive the nail 101 from the exit end 92.

As shown in FIG. 2, the nailing component 4 moves in the second direction, and the lifting device 5 is rotated by the driving shaft 53.

As shown in FIGS. 3, 4, 5, and 10, the latching device 7 is pivotable and loaded by the first spring 74; the pawl 73 of the latching device 7 is pivotable, loaded by the second spring 75; the pawl 73 has a pushed surface 731 and a dialed surface 732.

Under the first predetermined condition, when the nail member 4 is moved from its preparatory position toward the outlet end 92 of the member 9, the toggling slot 48 of the nailing member 4 guides the driving end 81 of the separating device 8 to the second longitudinal edge 46 of the nailing member 4, the toggling end 82 of the separating device 8 is rotated to dial the dialed surface 732 of the pawl 73, allowing the latching device 7 to be quickly separated from the second longitudinal edge 46 of the nailing member 4. When the toggling end 82 of the separating device 8 is rotated to a certain angle, the pawl 73 of the latching device 7 is released, and the latching device 7 is attached again to the second longitudinal edge 46 of the nailing component 4 by the action of the first spring 74.

Under the second predetermined condition, when the nailing component 4 returns to the preparatory position, the latching device 7 is pressed to the second longitudinal edge 46 of the nailing component 4, and the nailing component 4 directs the latching surface 71 of the latching device 7 to the latching groove 47 of the nailing component 4 to keep the nailing component 4 moving in the second direction without any reverse; when the toggling slot 48 of the nailing component moves to align with the driving end 81 of the separating device 8, the driving end 81 of the separating device 8 enters the toggling slot 48 of the nailing component 4 pushed by the third spring 83, and the nailing component 4 drives the separating device 8 to rotate, and the toggling end 82 of the separating device 8 pushes the pushed surface 731 of the pawl 73 of the latching device 7, and the pawl 73 of the latching device 7 lets by the toggling end 82 of the separating device 8 to bring the toggling end 82 to the dialed surface 732 of the pawl 73 of the latching device 7.

As shown in FIGS. 3 and 4, the separating device 8 is pivotable and loaded by a third spring 83. The driving end 81 of the separating device 8 is interlocked with the nailing component 4, and the toggling end 82 of the separating device 8 toggles the pawl 73 of the latching device 7.

An electric nail gun using a gas spring, further, the compressed air in its driving mechanism is stored in the gas storage chamber 3 and the working plenum 13, and the compressed air is in contact with the nailing piston 41 and is always pressurized to be higher than atmospheric pressure.

As shown in FIG. 2, an electric nail gun using a gas spring, the driving mechanism further includes at least one nailing piston seal 411 that functions to retain a majority of the pressurized gas in the air storage chamber 3 and working plenum 13.

An electric nail gun using a gas spring, the drive mechanism further comprises at least one seal 241 of pneumatic piston 24 that functions to increase the pressure of the gas within the plenum room 23.

An electric nail gun using a gas spring, the driving mechanism is further provided at least one check valve 26 between the gas storage chamber 3 and the plenum 23, which functions to drive the pressurized gas from the plenum 23 into the gas storage chamber 3.

An electric nail gun using a gas spring, the driving mechanism is further disposed with a pressure sensor 31 on the gas storage chamber 3 to detect the pressure of the compressed air in the gas storage chamber 3, and to stop the inflation in time to ensure the safety of the tool.

An electric nail gun using a gas spring, wherein the driving mechanism further has a pressure relief valve 32 on the gas storage chamber 3, which functions to discharge compressed air of the gas storage chamber 3 to ensure the safety during storage and transportation of the tool, and to eliminates the load on the one-way component 6 in the non-operating state.

Figure 1:
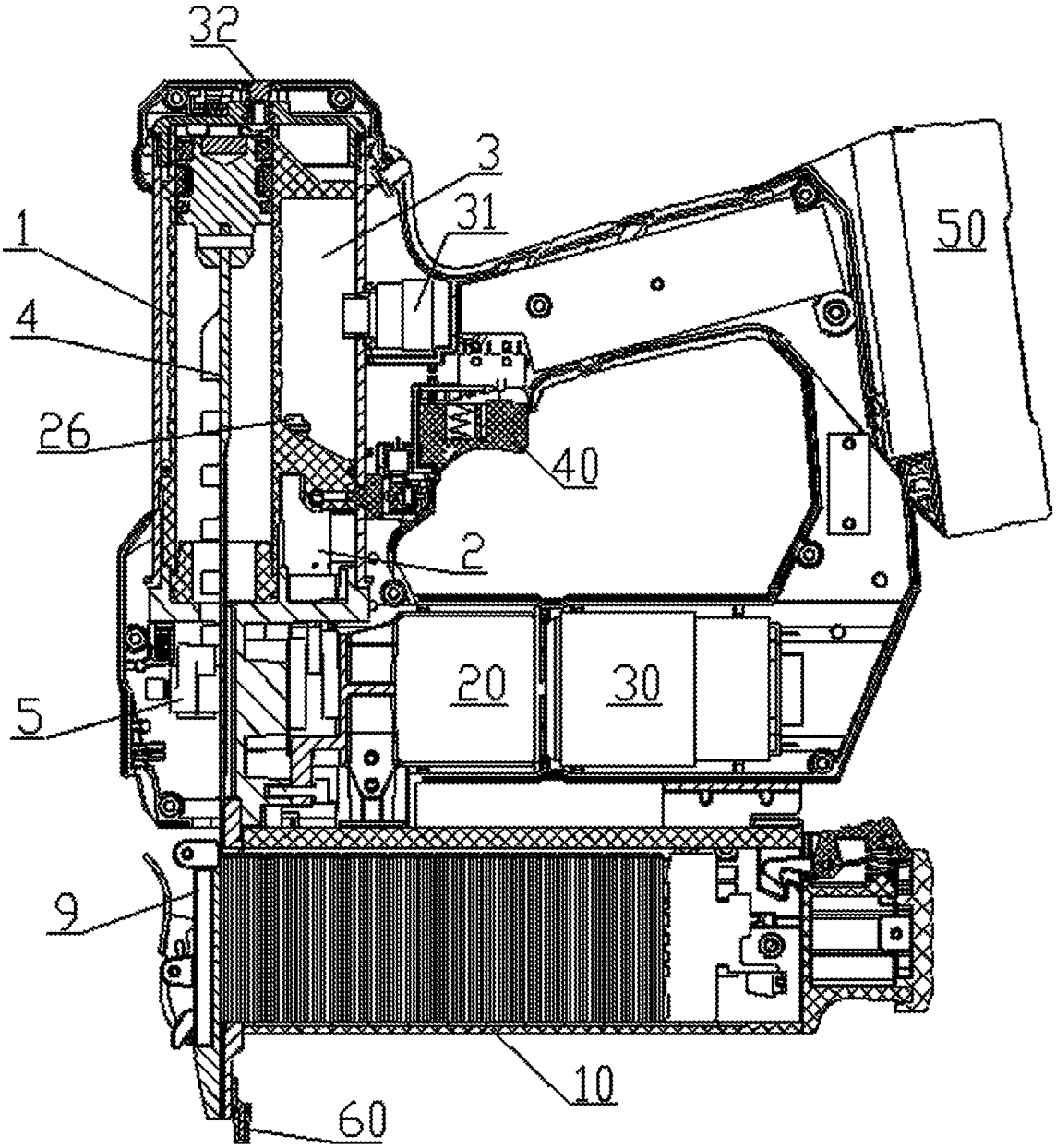
FIG. 1 is a side view in partial cross-section of a first embodiment of a fastener driving tool constructed according to the principles of the present invention.

As shown in FIG. 1, an electric nail gun using a gas spring, its driving mechanism further includes a magazine 10 for supporting a series of nails 101, and for continuously providing the nails 101 through the opening of the guiding component 9 to a corresponding position where the nailing component 4 operates in the driving stroke.

Figure 11:
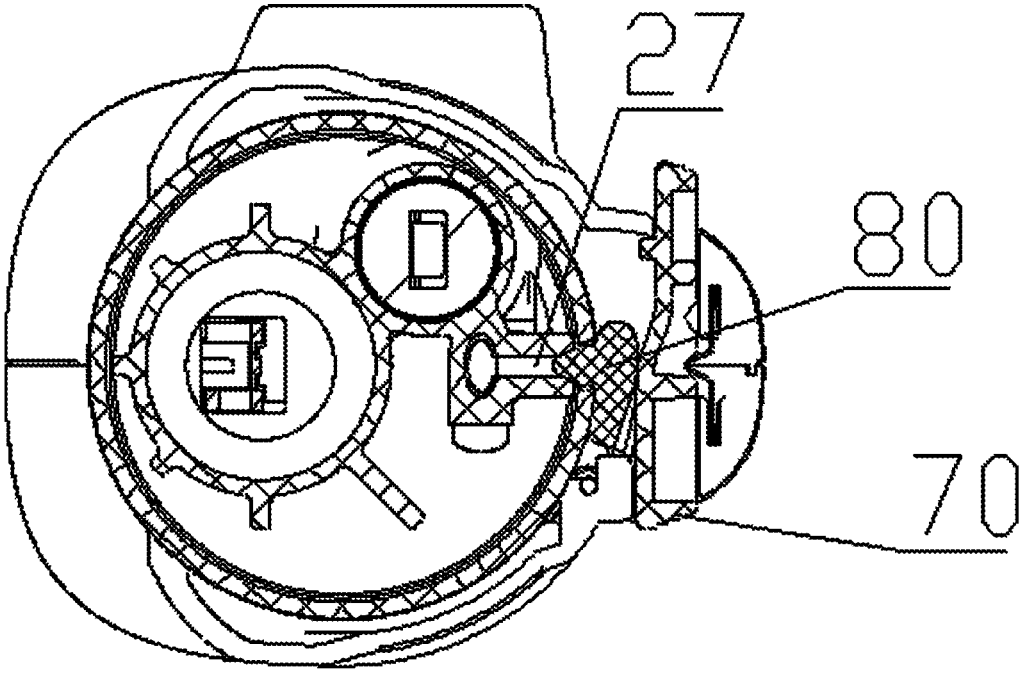
FIG. 11 is a schematic view of the driving mechanism in the case of shifting and inflating in the first embodiment of the present invention.
Figure 12:
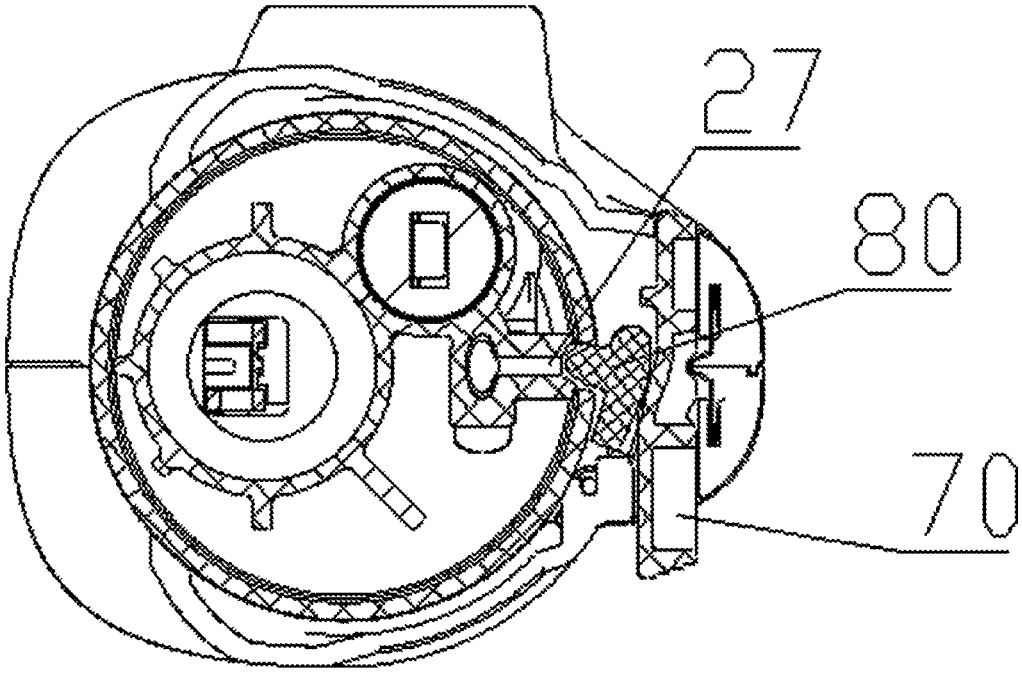
FIG. 12 is a schematic view of the drive mechanism in the case of shifting and nailing in the first embodiment of the present invention.

As shown in FIG. 1, an electric nail gun using a gas spring, its driving mechanism further includes a motor 30 driving the driving shaft 53 through the gearbox 20; under the third predetermined condition, as shown in FIGS. 9 and 11, when the shift lever 70 is put down, the air sealing plug 80 blocks the air sealing port 27, and the motor 30 reversely drives the pneumatic piston 24 to inflate, causing the compressed gas to enter the air storage chamber 3 through the check valve 26, while the pressure of the compressed air is detected by the pressure sensor 31 to stop the inflation at the appropriate time. Under the first predetermined condition, as shown in FIG. 1, 3, 4, 12, press the shift lever 70 back to open the air sealing port 27, and press the bumper 60 and then pull the trigger 40. The motor 30 rotates to drive the lifting device 5 to perform the nailing operation.

Embodiment 2

Figure 13:
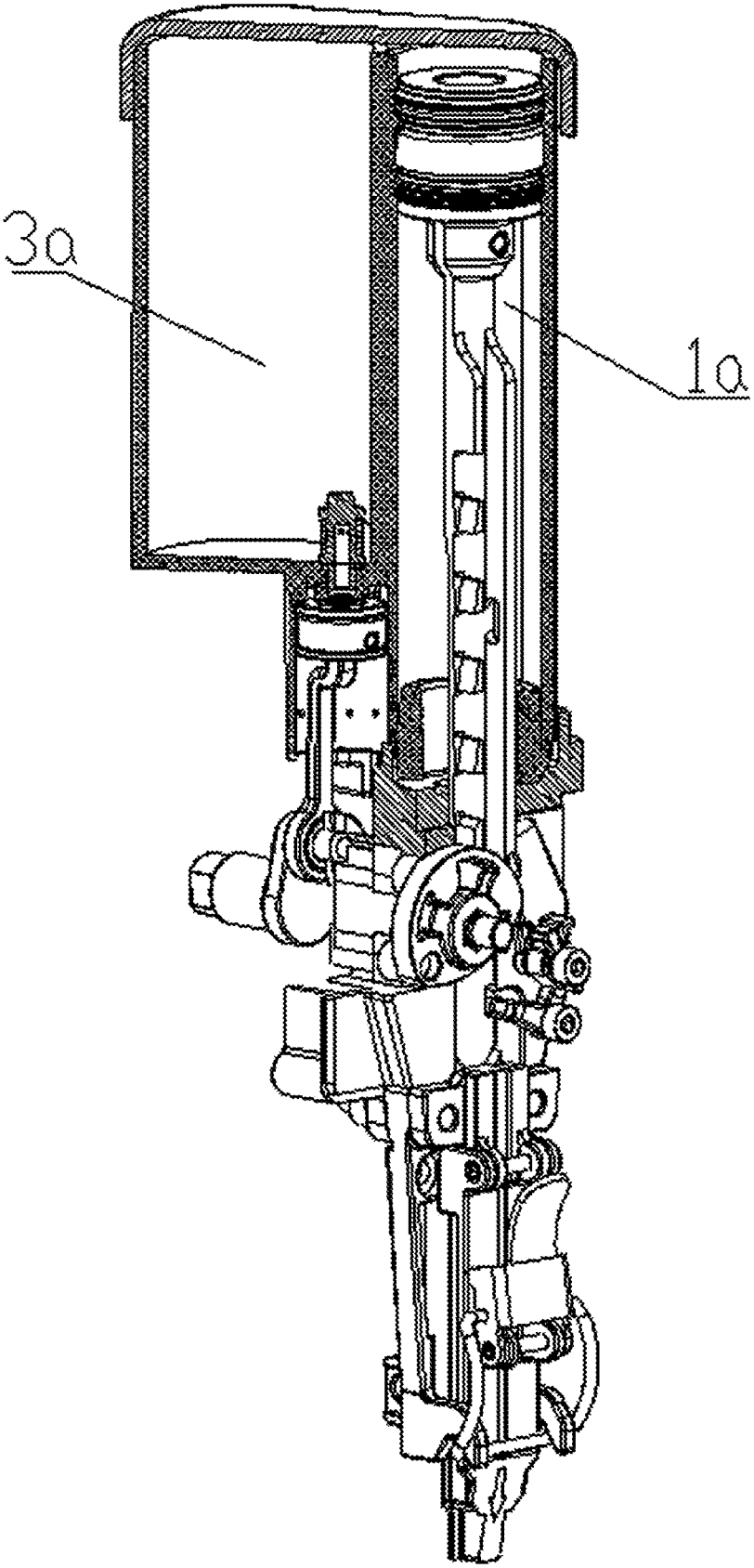
FIG. 13 is a schematic view showing the driving mechanism when the air storage chamber positions to a side of the working cylinder in the second embodiment of the present invention.

As shown in FIG. 13, an electric nail gun using a gas spring whose drive mechanism air chamber 3*a* is positioned to one side of the working cylinder 1*a*. The rest of the embodiment is the same as that of the embodiment 1.

Embodiment 3

Figure 14:
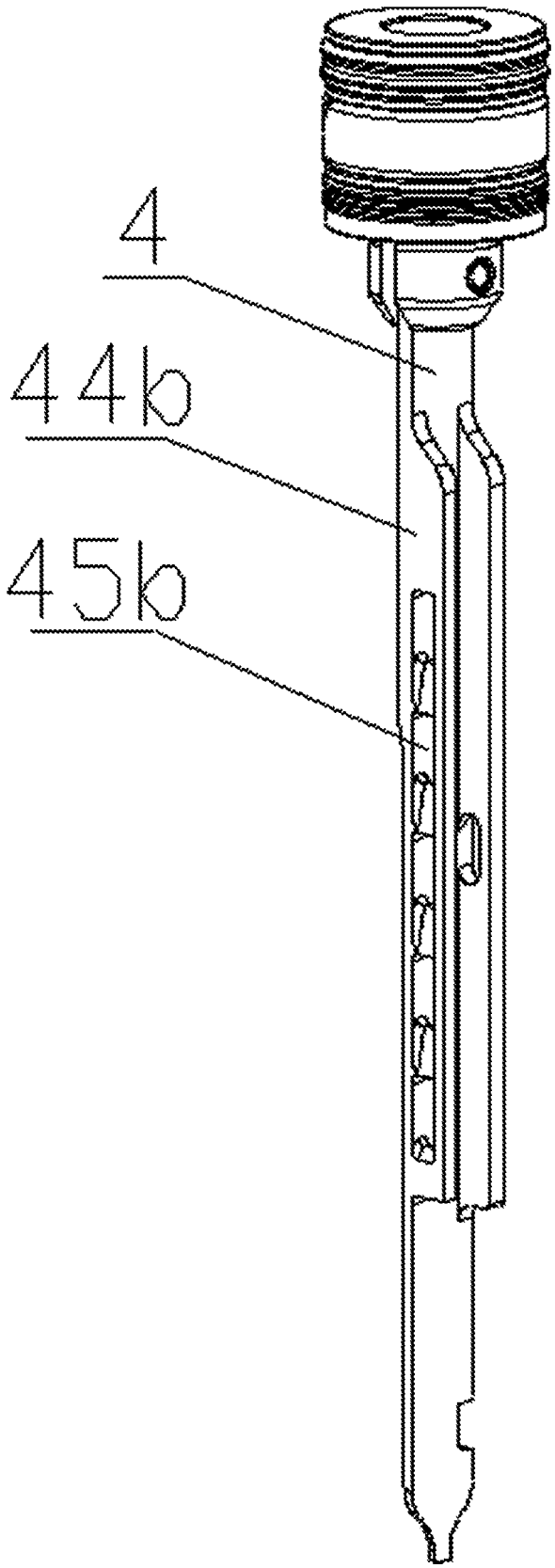
FIG. 14 is a schematic view showing the first longitudinal edge of the nailing component of the driving mechanism in the third embodiment of the present invention as a plurality of discontinuous slots.
Figure 19:
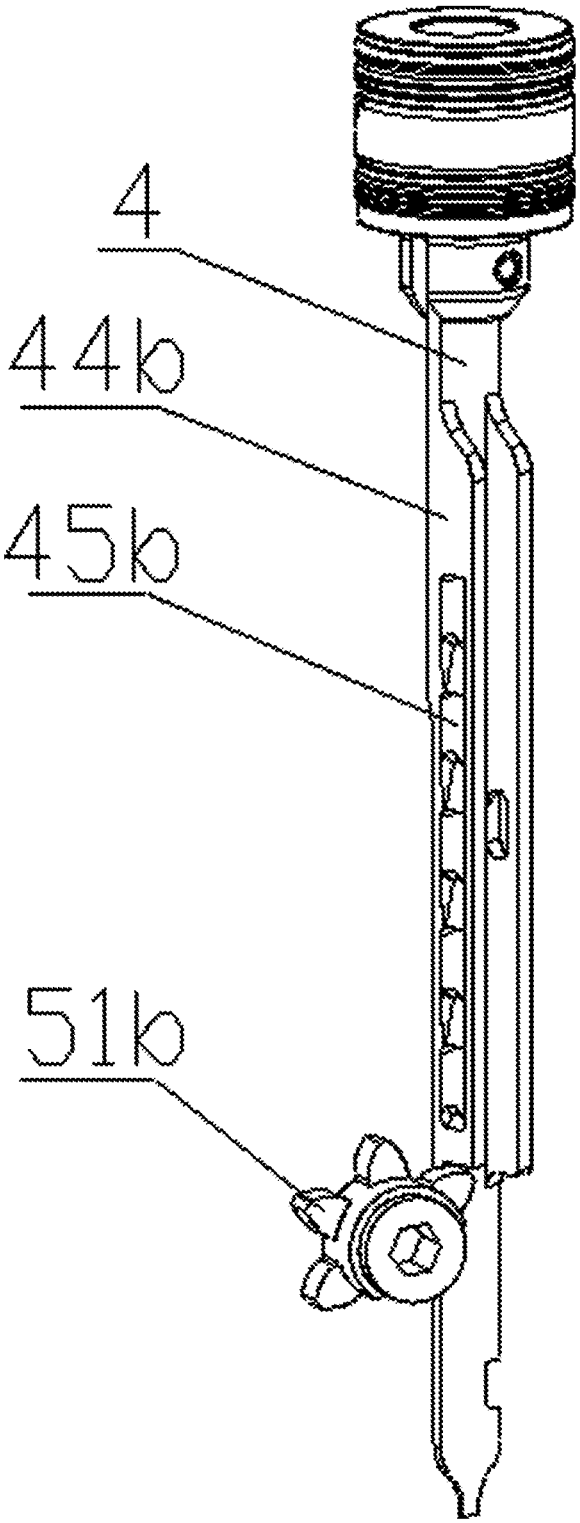
FIG. 19 is a schematic view showing a plurality of discontinuous slots on the first longitudinal edge of the nailing component of the driving mechanism cooperating with the discontinuous projecting teeth of the lifting device in the fifth embodiment of the present invention.

As shown in FIG. 14 and FIG. 19, an electric nail gun using a gas spring, its driving mechanism thereof including a nailing component 4 with a first longitudinal edge 44*b* having a plurality of discontinuous slots 45*b* which cooperate with discontinuous projecting teeth 51*b* of the lifting device 5, the first longitudinal edge 44*b* being substantially parallel to the direction of movement of the nailing member 4.

The rest of the embodiment is the same as that of embodiment 1.

Embodiment 4

Figure 15:
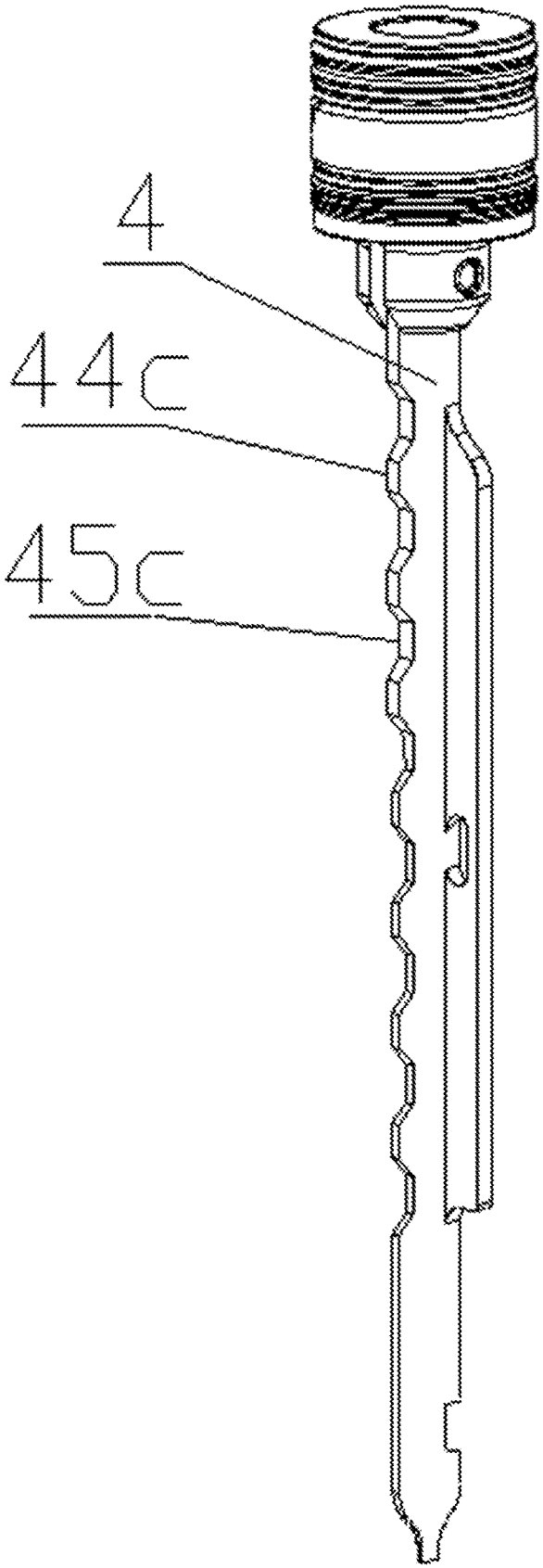
FIG. 15 is a schematic view showing the first longitudinal edge side of the nailing component of the driving mechanism in the fourth embodiment of the present invention as a plurality of discontinuous projections.
Figure 17:
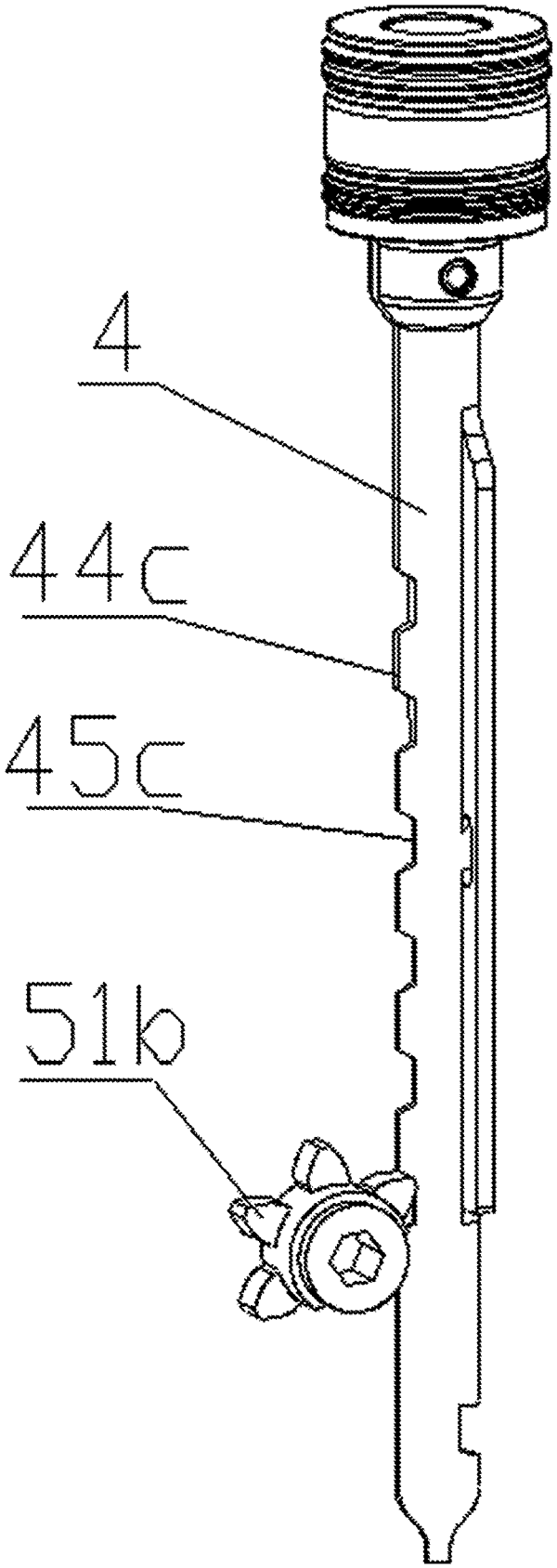
FIG. 17 is a schematic view showing a plurality of discontinuous protrusions on the first longitudinal edge side of the nailing component of the driving mechanism cooperating with the discontinuous projective teeth of the lifting device in the fourth embodiment of the present invention.

As shown in FIG. 15 and FIG. 17, an electric nail gun using a gas spring, its driving mechanism comprises a nailing component 4 with a first longitudinal edge 44*c* having a plurality of discontinuous protrusions 45*c* which cooperate with discontinuous projecting teeth 51*b* of the lifting device 5, the first longitudinal edge 44*c* being substantially parallel to the direction of movement of the nailing member 4.

Figure 18:
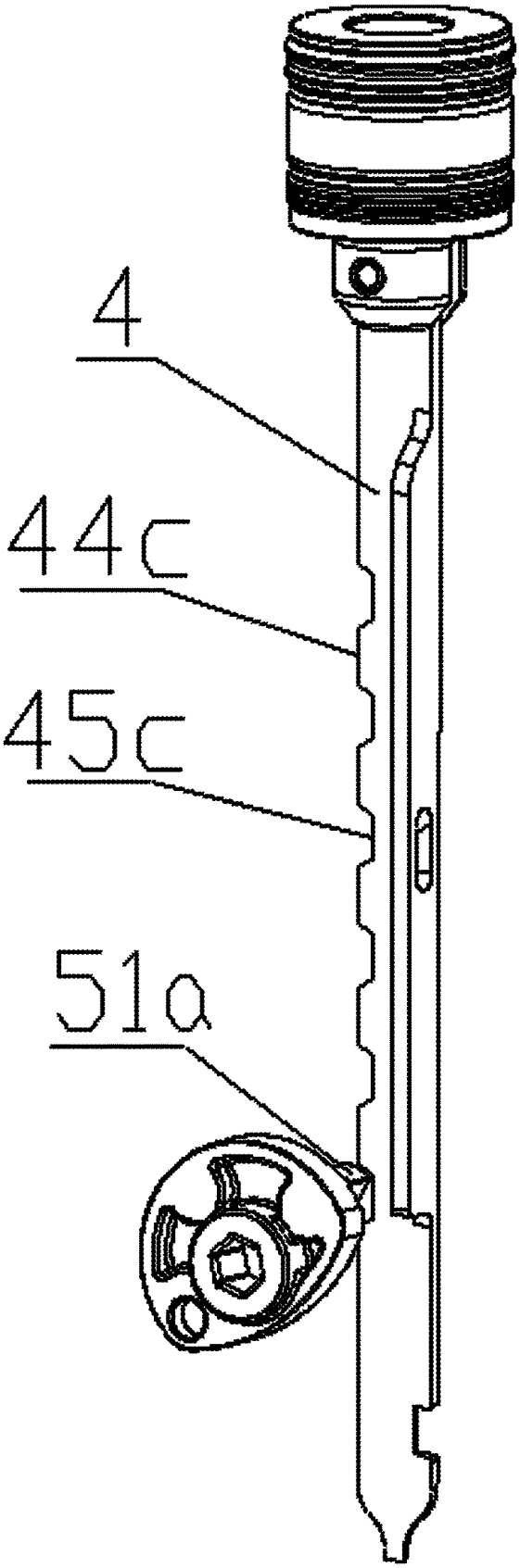
FIG. 18 is a schematic view showing a plurality of discontinuous protrusions on the first longitudinal edge side of the nailing component of the driving mechanism cooperating with the cylindrical projecting pins of the lifting device in the fourth embodiment of the present invention.

The rest of the embodiment is the same as that of embodiment 1. As shown in FIG. 15, FIG. 18, an electric nail gun using a gas spring, its driving mechanism comprises a nailing member 4 with the first longitudinal edge 44*c* having a plurality of discontinuous protrusions 45*c* which cooperate with cylindrical projecting pins 51*b* of the lifting device 5, the first longitudinal edge 44*c* being substantially parallel to the direction of movement of the nailing member 4.

The rest of the embodiment is the same as that of embodiment 1.

Embodiment 5

Figure 16:
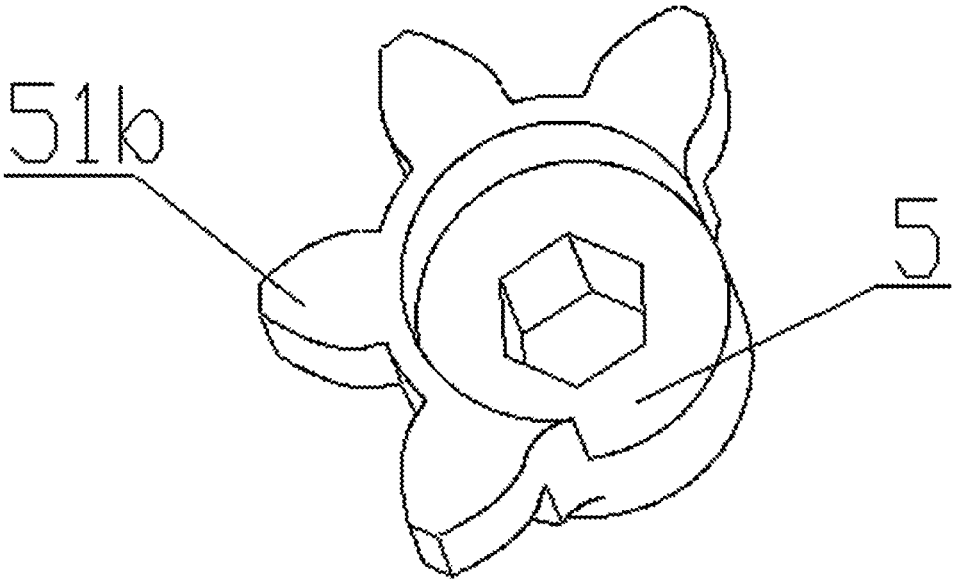
FIG. 16 is a schematic view showing the discontinuous convex tooth shape of the circumferential surface of the lifting device of the driving mechanism in the fifth embodiment of the present invention.
Figure 20:
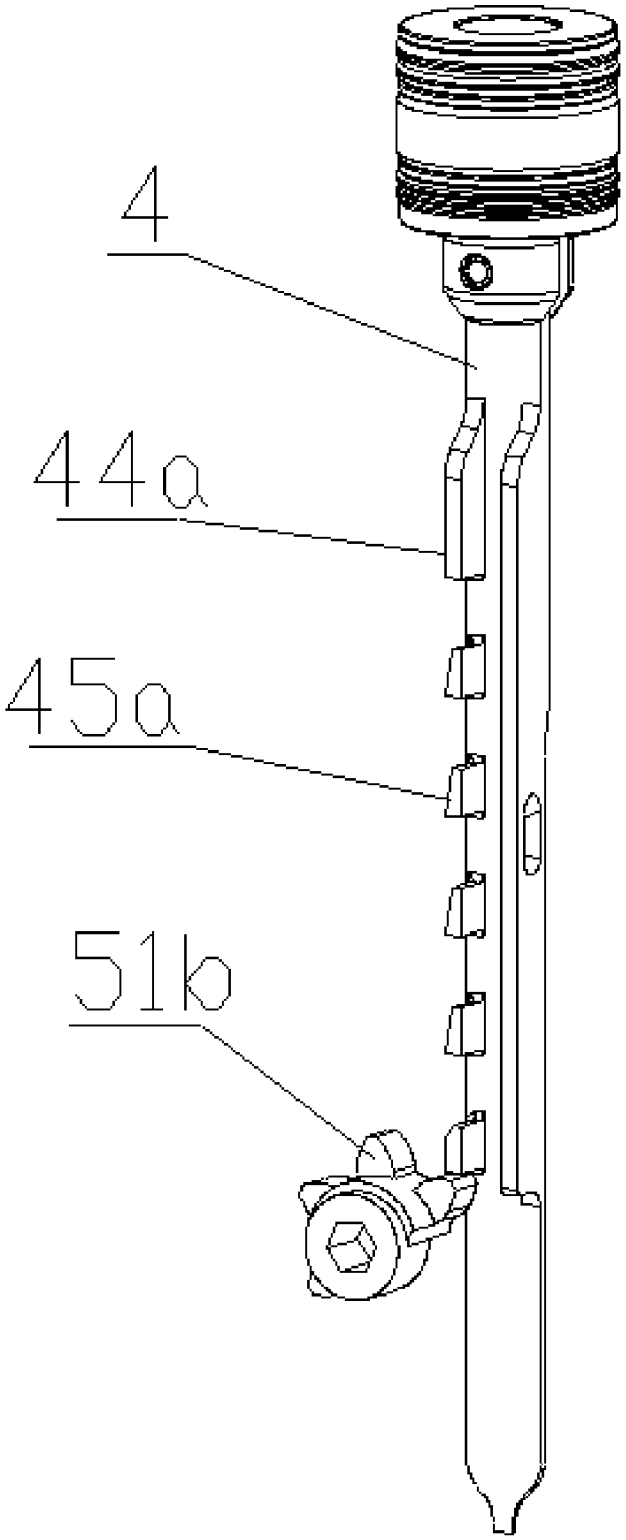
FIG. 20 is a schematic view showing the plurality of spaced-apart protrusions on the first longitudinal edge surface of the nailing component of the driving mechanism cooperating with the discontinuous projecting teeth of the lifting device in the driving mechanism of the fifth embodiment of the present invention.

As shown in FIG. 16 and FIG. 20, an electric nail gun using a gas spring, its driving mechanism comprises a lifting device 5 with a circumferential surface having a discontinuous projecting teeth 51*b* which contact the a plurality of spaced-apart protrusions 45*a* on the first longitudinal edge 44*a* of the nailing component 4 at the predetermined position of the discontinuous projecting teeth 51*b* of the lifting device 5, and the lifting device 5 drives the nailing component 4 to move from its nailing position to the preparatory position. The rest of the embodiment is the same as that of embodiment 1.

As shown in FIG. 16 and FIG. 19, an electric nail gun using a gas spring, its driving mechanism comprises a lifting device 5 with a circumferential surface having a discontinuous projecting teeth 51*b* which contact the a plurality of discontinuous slots 45*b* on the first longitudinal edge 44*b* of the nailing component 4 on the predetermined position of the discontinuous projecting teeth 51*b*, and the lifting device 5 drives the nailing component 4 to move from its nailing position to the preparatory position. The rest of the embodiment is the same as that of embodiment 1.

As shown in FIG. 16 and FIG. 17, an electric nail gun using a gas spring, its driving mechanism comprises a lifting device 5 with a circumferential surface having a discontinuous projecting teeth 51*b* which contact the a plurality of discontinuous protrusions 45*c* on the first edge longitudinal 44*c* of the nailing component 4 on the predetermined position of the discontinuous projecting teeth 51*b*, and the lifting device 5 drives the nailing component 4 to move from its nailing position to the preparatory position. The rest of the embodiment is the same as that of embodiment 1.

The invention is improved on the structure of the existing electric nail gun. The structure is simple and novel, and the performance is reliable, and the piston seal ring is easy to replace when worn, and the nailing speed is fast, and the work efficiency is high, and the unsafe factor of storage and transportation is completely solved.

The invention claimed is:

1. An electric nail gun using an air spring, a driving mechanism thereof comprising:

a working cylinder;
a pneumatic cylinder;
an air storage chamber;
a nailing component;
a lifting device;
a one-way component;
a latching device;
a separating device; and
a guiding component;

wherein:

(1) the working cylinder comprises a cylindrical wall and has a nailing piston which is movable within the working cylinder, said working cylinder has a first end and a second end, opposite to the first end between which there is a working plenum, said working plenum containing a displacement volume created by a stroke of the nailing piston;

(2) the pneumatic cylinder has a fifth end and a sixth end, opposite to the fifth end, and a pneumatic room between the fifth and sixth ends, wherein a pneumatic piston moves within the pneumatic cylinder, said fifth end being in one-way fluidic communication with the air storage chamber, said sixth end having an air intake hole;

(3) the air storage chamber being in fluidic communication with said working plenum of the working cylinder, and configured to unidirectionally receive air from the pneumatic room;

(4) the nailing component comprises a third end and a fourth end, opposite to the third end, wherein the nailing piston is coupled to the third end of the nailing component, wherein:

(i) the fourth end is sized and shaped to push a nail from an exit end of the guiding component, wherein a passageway of the guiding component allows said nailing component to pass therethrough toward said exit end during a driving stroke and toward a receiving end during a return stroke, wherein when at a nailing position, the nailing component protrudes toward said exit end of the guiding component after said nailing piston moves toward the second end of said working cylinder, and when at a preparatory position, the nailing component is withdrawn into said guiding component after the nailing piston moves toward the first end of said cylinder, (ii) the nailing component comprises a first longitudinal edge that is substantially parallel to a direction of movement of said nailing component between the nailing position and the preparatory position, said nailing component having a discontinuous working surface with at least one plurality of spaced-apart protrusions along said first longitudinal edge for cooperating with a plurality of cylindrical projecting pins of the lifting device;

(iii) the nailing component comprises a second longitudinal edge that is substantially parallel to the direction of movement of said nailing component between the nailing position and the preparatory position, said second longitudinal edge having a latching groove for cooperating with the latching device;

(iiii) the nailing component having a toggling slot adjacent the fourth end for cooperating with the separating device, the toggling slot being configured to interlock with the separating device;

(5) the lifting device includes a cam having a discontinuous contact surface, a cam edge of the cam is divided into a lifting section and a detaching section, and the lifting section is provided with the plurality of cylindrical projecting pins, the cylindrical projecting pins are inserted sequentially into the spaced-apart protrusions of the first longitudinal edge of the nailing component in turn to lift the nailing component, wherein no cylindrical projecting pins are disposed on the detaching section;

wherein, under a second predetermined condition, the lifting section of the cam faces the first longitudinal edge, such that the cylindrical projecting pins contact the discontinuous working surface with the at least one plurality of spaced-apart protrusions along said first longitudinal edge of the nailing component, the lifting device drives the nailing component from the nailing position to the preparatory position;

wherein, under a first predetermined condition, the detaching section of the cam faces the first longitudinal edge of the nailing component to allow the nailing component to move in a first direction towards the exit end of the guiding component;

(6) the one-way component drives the lifting device to rotate, the lifting device drives the nailing component to move to the preparatory position;

wherein, under the second predetermined condition, the one-way component keeps the nailing component in the preparatory position;

wherein, under a third predetermined condition, the pneumatic piston reciprocates in the pneumatic cylinder to compress air into the air storage chamber while a rotation of the one-way component does not drive the lifting device to move;

(7) the latching device comprises a latching surface, a sliding surface and a pawl;

(8) the separating device comprises a driving end and a toggling end;

(i) wherein, under the first predetermined condition, while the nailing piston pushes the nailing component from the preparatory position to the exit end of the guiding component in the first direction under an action of compressed air in the working cylinder and the air storage chamber, the toggling slot of the nailing component directs the driving end of the separating device, and the toggling end of the separating device pushes the latching device to separate from the nailing component and drives the pawl of the latching device to cause said sliding surface of the latch device to enter a non-catching position such that its latching surface does not interfere with the latching groove of the second longitudinal edge of the nailing component, thereby allowing the nailing component to move from the preparatory position to the exit end of the guiding component in the first direction;

(ii) wherein, under the second predetermined condition, when the nailing component returns to the preparatory position, the separating device releases the latching device so that the latching device is pressed to the second longitudinal edge of the nailing component allowing the second longitudinal edge of the nailing component to slide along the sliding surface of the latching device, and the nailing component directs the latching surface of the latching device toward the latching groove of the nailing component until the latching surface of the latching device interferes with the latching groove of the nailing component so that the nailing component keeps on moving in a second direction without any reverse movement in the first direction when the detaching surface of the lifting mechanism faces the first longitudinal edge of the nailing component;

(9) the guiding component is disposed adjacent to the second end of the working cylinder and has the receiving end, the exit end, and the passageway between the receiving end and the exit end, the receiving end being adjacent to the second end of the working cylinder, the guiding component being configured to receive a nail from the exit end.

2. The electric nail gun as recited in claim 1, wherein the air gas storage chamber is configured as one of the following:

(a) substantially surrounding at least a portion of the working cylinder, or (b) substantially standing by one side of the working cylinder.

3. The electric nail gun as recited in claim 1, wherein while the nailing component is moving in the second direction, the lifting device is rotated by a driving shaft.

4. The electric nail gun as recited in claim 1, wherein the latching device is pivotable and loaded by a spring; the pawl of the latching device is pivotable and loaded by a spring; the pawl has a pushed face and a dialed face;

(4a) under the first predetermined condition, when the nailing component moves from its preparatory position to the exit end of the guiding component, the toggling slot of the nail component directs the driving end of the separating device to press to the second longitudinal edge of the nailing component, and the toggling end of the separating device is rotated to drive the dialed surface of the pawl of the latching device, so that the latching device is separated from the second longitudinal edge of the nailing component, wherein when the toggling end of the separating device is rotated to an angle, the pawl of the latching device is released, and the latching device is press against the second longitudinal edge of the nailing component again under the action of a spring force;

(4b) under the second predetermined condition, when the nailing component returns to the preparatory position, the latching device is pressed to the second longitudinal edge of the nailing component, the latching device is directed toward the latching groove of the nailing component until the latching surface of the latching device interferes with the latching groove of the nailing component, so that the nailing component remains moving in the second direction without any reverse, wherein when the toggling slot of the nailing component moves to align with the driving end of the separating device, the driving end of the separating device enters the toggling slot of the nailing component under the action of a spring force, the nailing component drives the separating device to rotate, the toggling end of the separating device pushes the pushed surface of the pawl of the latching device, and the pawl of the latching device dodges the toggling end of the separating device to bring the toggling end of the separating device to the dialed surface of the pawl of the latching device.

5. The electric nail gun as recited in claim 1, wherein the separating device is pivotable and loaded by a spring, the driving end of the separating device is interlocked with the nailing component, and the toggling end of the separating device toggles the pawl of the latching device.

6. The electric nail gun as recited in claim 1, wherein: the compressed air is stored in the air storage chamber and the working plenum, the compressed air pushes the nailing piston and is always pressurized above atmospheric pressure.

7. The electric nail gun as recited in claim 1, wherein at least one seal of the nailing piston is included that functions to retain a majority of the compressed air in the air storage chamber and working plenum.

8. The electric nail gun as recited in claim 1, wherein at least one seal of the pneumatic piston is included that functions to increase the pressure of the air in the pneumatic room.

9. The electric nail gun as recited in claim 1, wherein at least one check valve is disposed between the air storage chamber and the pneumatic room that functions to one-way pressurize compressed air from the pneumatic room into the air storage chamber.

10. The electric nail gun as recited in claim 1, wherein: a pressure sensor is disposed on the air storage chamber to detect the pressure of the compressed air in the air storage chamber, and to stop an inflation in time to ensure a safety of a tool.

11. The electric nail gun as recited in claim 1, wherein a pressure relief valve is disposed on the air storage chamber to discharge compressed air of the air storage chamber to ensure a safety of a tool during a storage and transportation, and to eliminate a load on the one-way component in a non-working state.

12. The electric nail gun as recited in claim 1, wherein a magazine is disposed for supporting a series of nails, and for continuously providing the nails through an opening of the guiding component to a corresponding position where the nailing component operates in the driving stroke.

13. The electric nail gun as recited in claim 1, wherein:

(a) the first predetermined condition occurs during a driving stroke phase;

(b) the second predetermined condition occurs in a lift interval phase;

(c) the third predetermined condition occurs during an inflation phase.

14. An electric nail gun using an air spring, a driving mechanism thereof comprising:

a working cylinder;

a nailing component;

a lifting device;

a one-way component;

a latching device;

a separating device, and a guiding component;

wherein:

(1) the working cylinder comprises a cylindrical wall and has a nailing piston which is movable within the working cylinder, said working cylinder has a first end and a second end, opposite to the first end between which there is a working plenum, said working plenum containing a displacement volume created by a stroke of the nailing piston;

(2) the nailing component comprising a third end and a fourth end, opposite to the third end, wherein the nailing piston is coupled to the third end of the nailing component, including:

(i) the fourth end is sized and shaped to push a nail from an exit end of the guiding component, wherein a passageway of the guiding component allows said nailing component to pass therethrough toward said exit end during a driving stroke and toward a receiving end during a return stroke, wherein when at a nailing position, said nailing component protrudes toward said exit end of the guiding component after said nailing piston moves toward the second end of said working cylinder, and when at a preparatory position, said nailing component is withdrawn into said guiding component after the nailing piston moves toward the first end of said cylinder, (ii) the nailing component comprises a first longitudinal edge that is substantially parallel to a direction of movement of said nailing component between the nailing position and the preparatory position, said nailing component having a discontinuous working surface with at least one plurality of spaced-apart protrusions along said first longitudinal edge for cooperating with cylindrical projecting pins of the lifting device;

(iii) the nailing component comprises a second longitudinal edge that is substantially parallel to the direction of movement of said nailing component between the nailing position and the preparatory position, said second longitudinal edge having a latching groove for cooperating with the latching device;

(iiii) the nailing component having a toggling slot adjacent the fourth end for cooperating with the separating device, the toggling slot being configured to interlock with the separating device;

(3) the lifting device including a cam having a discontinuous contact surface, a cam edge of the cam being divided into a lifting section and a detaching section, and the lifting section being provided with the plurality of cylindrical projecting pins, the cylindrical projecting pins are inserted sequentially into the spaced-apart protrusions of the first longitudinal edge of the nailing component in turn to lift the nailing component, wherein no cylindrical projecting pins are disposed on the detaching section;

wherein, under a second predetermined condition, the lifting section of the cam faces the first longitudinal edge such that the cylindrical projecting pins contact the discontinuous working surface with the at least one plurality of spaced-apart protrusions along said first longitudinal edge of the nailing component, the lifting device drives the nailing component from the nailing position to the preparatory position;

wherein, under a first predetermined condition, the detaching section of the cam faces the first longitudinal edge of the nailing component to allow the nailing component to move in a first direction towards the exit end of the guiding component;

(4) the one-way component drives the lifting device to rotate, the lifting device drives the nailing component to move to the preparatory position, under the second predetermined condition, the one-way component keeps the nailing component in the preparatory position; under third predetermined conditions, a rotation of the one-way component does not drive the lifting device to move;

(5) the latching device having a latching surface, a sliding surface and a pawl;

(6) the separating device having a driving end and a toggling end;

(i) wherein, under the first predetermined condition, while the nailing piston pushes the nailing component from the preparatory position to the exit end of the guiding component in the first direction under an action of compressed air in the working cylinder; the toggling slot of the nailing component directs the driving end of the separating device, and the toggling end of the separating device pushes the latching device to separate from the nailing component and drives the pawl of the latching device to cause said sliding surface of the latch device to enter a non-catching position such that its latching surface does not interfere with the latching groove of the second longitudinal edge of the nailing component, thereby allowing the nailing component to move from the preparatory position to the exit end of the guiding component in the first direction;

(ii) wherein, under the second predetermined condition, when the nailing component returns to the preparatory position, the separating device releases the latching device so that the latching device is pressed to the second longitudinal edge of the nailing component allowing the second longitudinal edge of the nailing component to slide along the sliding surface of the latching device, and the nailing component directs the latching surface of the latching device toward the latching groove of the nailing component until the latching surface of the latching device interferes with the latching groove of the nailing component so that the nailing component keeps on moving in a second direction without any reverse movement in the first direction when the detaching surface of the lifting mechanism faces the first longitudinal edge of the nailing component;

(7) the guiding component is disposed adjacent to the second end of the working cylinder and has the receiving end, the exit end, and the passageway between the receiving end and the exit end, the receiving end being adjacent to the second end of the working cylinder, the guiding component being configured to receive a nail from the exit end.

* * * * *